US006178306B1

(12) United States Patent
Mizoguchi et al.

(10) Patent No.: US 6,178,306 B1
(45) Date of Patent: Jan. 23, 2001

(54) DEVELOPER BEARING BODY ELECTROLESS PLATED ON BLASTED SURFACE USING SPHERICAL PARTICLES, PRODUCTION METHOD THEREFOR AND DEVELOPING APPARATUS USING THE SAME

(75) Inventors: Yoshito Mizoguchi, Kawasaki; Takao Honda, Mishima; Kazuo Suzuki, Yokohama; Nobuaki Hara, Numazu, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/187,746

(22) Filed: Nov. 9, 1998

(30) Foreign Application Priority Data

Nov. 10, 1997 (JP) ..... 9-323766
Sep. 18, 1998 (JP) ..... 10-283474

(51) Int. Cl.[7] ..... G03G 15/08; G03G 15/09

(52) U.S. Cl. ..... 399/276; 29/895; 148/518; 399/267; 492/37; 492/53

(58) Field of Search ..... 399/276, 265, 399/267, 279, 286, 96, 159; 492/28, 37, 53; 29/895, 895.3, DIG. 36; 430/120, 122, 109, 111; 148/516, 518, 527, 537; 205/222, 227

(56) References Cited

U.S. PATENT DOCUMENTS

| | | | | |
|---|---|---|---|---|
| 4,331,101 | * | 5/1982 | Muller et al. | 399/276 |
| 4,380,966 | | 4/1983 | Isaka et al. | 399/270 |
| 4,526,130 | * | 7/1985 | Fukuda et al. | 399/276 |
| 4,870,461 | | 9/1989 | Watanabe et al. | 399/270 |
| 5,185,496 | * | 2/1993 | Nishimura et al. | 399/276 X |
| 5,286,917 | * | 2/1994 | Unno et al. | 399/279 |
| 5,300,987 | * | 4/1994 | Aoyama et al. | 399/96 |
| 5,545,268 | * | 8/1996 | Yashiki et al. | 148/518 |
| 5,749,033 | * | 5/1998 | Swartz et al. | 399/267 |
| 5,781,830 | | 7/1998 | Gaylord et al. | 399/109 |

FOREIGN PATENT DOCUMENTS

| | | | |
|---|---|---|---|
| 0 478 317 A2 | | 4/1992 | (EP) . |
| 54-79043 | | 6/1979 | (JP) . |
| 55-26526 | | 2/1980 | (JP) . |
| 57-66455 | | 4/1982 | (JP) . |
| 57-086869 | | 5/1982 | (JP) . |
| 57-116372 | | 7/1982 | (JP) . |
| 58-011974 | * | 1/1983 | (JP) . |
| 58-132768 | | 8/1983 | (JP) . |
| 60-130770 | | 7/1985 | (JP) . |
| 61-219974 | * | 9/1986 | (JP) . |
| 1-131586 | * | 5/1989 | (JP) . |
| 1-276174 | | 11/1989 | (JP) . |
| 2-064561 | * | 3/1990 | (JP) . |
| 3-041485 | | 2/1991 | (JP) . |
| 3-233581 | | 10/1991 | (JP) . |
| 5-027581 | * | 2/1993 | (JP) . |
| 6-003964 | * | 1/1994 | (JP) . |
| WO 96/25692 | | 8/1996 | (WO) . |

* cited by examiner

*Primary Examiner*—Sophia S. Chen
(74) *Attorney, Agent, or Firm*—Fitzpatrick, Cella, Harper & Scinto

(57) ABSTRACT

A method of fabricating a developer bearing body includes the steps of preparing metallic base material blasting the surface of the metallic base material using spherical particles and plating the surface of the metallic base material blasted, wherein a thickness of the plating layer is two or more times as large as a particle diameter in volume average of the developer.

38 Claims, 10 Drawing Sheets

50 μm

50 μm

DEVELOPER BEARING BODY ELECTROLESS PLATED ON BLASTED SURFACE USING SPHERICAL PARTICLES, PRODUCTION METHOD THEREFOR AND DEVELOPING APPARATUS USING THE SAME

BACKGROUND OF THE INVENTION

1. Field of the Invention

The present invention is used for image forming apparatuses such as copying machines and printers using the electrophotographic method and the electrostatic recording method, and relates to a developing apparatus for developing an electrostatic image on an image bearing body, a developer bearing body used for this developing apparatus and a production method for the developer bearing body.

2. Related Background Art

Conventionally, in an image forming apparatus of, for example, the electrophotographic type, an electrostatic latent image has been formed on an image bearing body made of electrophotographic photoreceptor, and the latent image has been developed by a developer unit. The developer unit has a development sleeve as a developer bearing body for bearing developer to convey.

The surface of this development sleeve is unevenly roughened to promote the conveyance of developer, and there are known knurled grooves in a development sleeve mainly for two-component development as shown in, for example, Japanese Patent Application Laid-Open No. 54-79043 formerly, and blasting treatment in a development sleeve mainly for one-component development as shown in Japanese Patent Application Laid-Open No. 55-26526.

In the case of a development sleeve subjected to blasting treatment, since asperities on the surface are prone to be worn and reduced by long-term use, for example, high-hardness material such as SUS (Vickers hardness Hv≅180) is most frequently used for the material for the development sleeve in order to prevent the wear, and formerly the Alundum blasting method has been used in which alumina particles are used as blasting abrasive grains (Japanese Patent Application Laid-Open No. 57-66455).

As shown in Japanese Patent Application Laid-Open Nos. 57-116372, 58-11974, 1-131586 and the like, however, a sharp, uneven roughened surface is formed on the surface of a development sleeve made of SUS in the blasting treatment using Alundum. FIG. 14 is a schematic view showing a roughness profile curve for the development sleeve surface subjected to the Alundum blasting treatment. During long-term use, it is known that specially-fine toner and the like will be filled in sharp concave portions on this surface (hereinafter, the state in which this toner and the like are filled in will be referred to as "sleeve contamination"), and charging of toner in the portions will be hindered to cause a defective image.

Thus, a method of performing blasting treatment using spherical particles such as, for example, glass beads is considered. FIG. 15 is a schematic view showing a similar roughness profile curve using the glass beads blasting treatment. As shown in FIG. 15, the roughened surface having a smooth cross-sectional shape on the surface of the development sleeve of SUS can be obtained according to the glass beads blasting treatment, and the sleeve contamination can be reduced.

On the other hand, as the material for the development sleeve, aluminum is popularly being used. This is because if aluminum is used, the cost of the sleeve could be reduced although SUS is expensive, and if an a-Si drum (amorphous silicon drum) is used as a photosensitive drum, the aluminum sleeve will be indispensable for the following reason.

When the a-Si drum is used as a photosensitive drum at high humidities, an electric discharge product (such as NOx) adhering to the surface of the photosensitive drum takes up moisture so that surface charge on the photosensitive drum which forms an electrostatic latent image after charging and exposure escapes in the vicinity through the electric discharge product to disturb the latent image, resulting in a turbulent image. In order to prevent this turbulent image, there is a method in which the surface is made easier to be shaved like an OPC drum and the surface layer including NOx is shaved. This method is effective for the flow of the image, but the life of the a-Si drum will be naturally shortened. Thus, a surface-like heating element or the like is placed into the photosensitive drum, and it is heated while the image forming apparatus is in a standby state, to prevent the electric discharge product from taking up moisture. However, the heat at the photosensitive drum is transmitted to the development sleeve which is opposed thereto. If it is made of SUS having low thermal conductivity, the development sleeve will be considerably thermally deformed. When it is the first copy after the standby and for example, a halftone image which ought to have uniform density is copied, a defective image occurs as sleeve pitch-shaped unevenness in the density. In contrast, the development sleeve made of aluminum is hardly thermally deformed, and such unevenness in the density as the deformation is made conspicuous hardly appears. Therefore, it is indispensable to combine the aluminum sleeve with the a-Si drum (with a built-in heater).

Since, however, the aluminum sleeve has as low hardness as Hv≅100, the asperities on the surface provided by the blasting treatment will be easily worn by use and reduced soon.

For this reason, as shown in Japanese Patent Application Laid-Open No. 1-276174, there is a carbon-coated development sleeve having high-hardness resin coated on the surface of the aluminum sleeve. As high-hardness resin, for example, phenolic resin is coated on the surface of the aluminum sleeve, and graphite is dispersed on the phenolic resin in advance to thereby obtain the conductivity required as the development sleeve.

In the carbon-coated sleeve, the phenolic resin is coated with a thickness of about 10 to 20 $\mu$m by dipping or spraying, and therefore, the resin surface basically takes over the uneven shape of the aluminum surface as the substrate. The minute surface property, however, looks as if graphite particles 102 are imbedded in the phenolic resin 100 as shown in FIG. 16, and the roughness cross-sectional shape is comparatively close to the surface state subjected to the Alundum blasting treatment shown in FIG. 14, having a surface on which sharp asperities are present. Toner is imbedded in these sharp concave portions to easily cause the sleeve contamination.

This carbon-coated sleeve has conventionally been used for a developer unit for laser beam printers (LBP) for negatively chargeable OPC, digital copying machines and the like. In the case of LBP, long-term use is not assumed because the development sleeve is also included in a cartridge as consumables. The development is of the reversal development system using negative toner. The resin used as negative toner such as, for example, styrene acryl and polyester is basically strongly negatively chargeable. The negative toner is highly electrified, and the toner can have a sufficient amount of charge even if the sleeve contamination occurs, and therefore, there were many cases where almost no problem is presented. Also, since the carbon-coated sleeve is also shaved little by little, it may be considered that the contaminant also might have been shaved together. For the reason, however, the carbon-coated sleeve was inferior to SUS in respect of life although it has high hardness.

In recent years, however, there has been the tendency to further reduce the toner particle diameter in order to improve the image quality, and it could be understood that the sleeve contamination is prone to occur more than before.

With reference to FIG. 17, this will be described. FIG. 17 is a view obtained by enlarging the asperities in the roughness profile curve of FIG. 15. FIG. 15 is, as described above, the roughness profile curve obtained when the surface of the development sleeve made of SUS is subjected to the blasting treatment using spherical particles of glass beads. In FIG. 17, in the case of large-diameter toner, it does not enter cracks in large asperities in the roughness profile curve, i.e., small concave portions such as, for example, concave portions a, b and c, but if the toner is turned into smaller-diameter, it is considered that toner which enters those small concave portions a, b and c, and the like, will be increased to thereby cause the sleeve contamination.

In small-diameter toner having particle size distribution for an average particle diameter of, for example, 7 $\mu$m, there is contained 15 to 20% of smaller toner having particle diameter of 4 $\mu$m or less, and these toner enter small concave portions a, b, c and the like. Of course, if fine powder in the toner is removed, it will be possible to reduce smaller toner, but smaller toner cannot be reduced to 0% in the manufacturing cost of the toner.

Also, even if the particle diameter of the toner is not reduced as described above, if toner having low electrification property (particularly, positive toner) is used, slight sleeve contamination easily causes inhibited electrification of toner, resulting in a problem of low density.

Under such circumstances, it becomes necessary to take a countermeasure against the sleeve contamination in order to extend the life of the developer unit.

SUMMARY OF THE INVENTION

It is an object of the present invention to provide a developer bearing body and a developing apparatus which prevent contamination due to toner.

It is another object of the present invention to provide a developer bearing body and a developing apparatus capable of using toner having small particle diameter or toner having low electrification property.

It is still another object of the present invention to provide a method of fabricating a developer bearing body, comprising the steps of: preparing metallic base material; blasting the surface of the metallic base material using spherical particles; and electroless plating the surface of the metallic base material blasted.

It is yet another object of the present invention to provide a developer bearing body having metallic base material whose surface has been blasted using spherical particles and an electroless plating layer provided on the metallic base material blasted, and a developing apparatus using this developer bearing body.

Further object of the present invention will be apparent from the following description.

DESCRIPTION OF THE PREFERRED EMBODIMENTS

Hereinafter, with reference to the accompanying drawings, the detailed description will be made of embodiments according to the present invention.

First Embodiment

Figure 1:
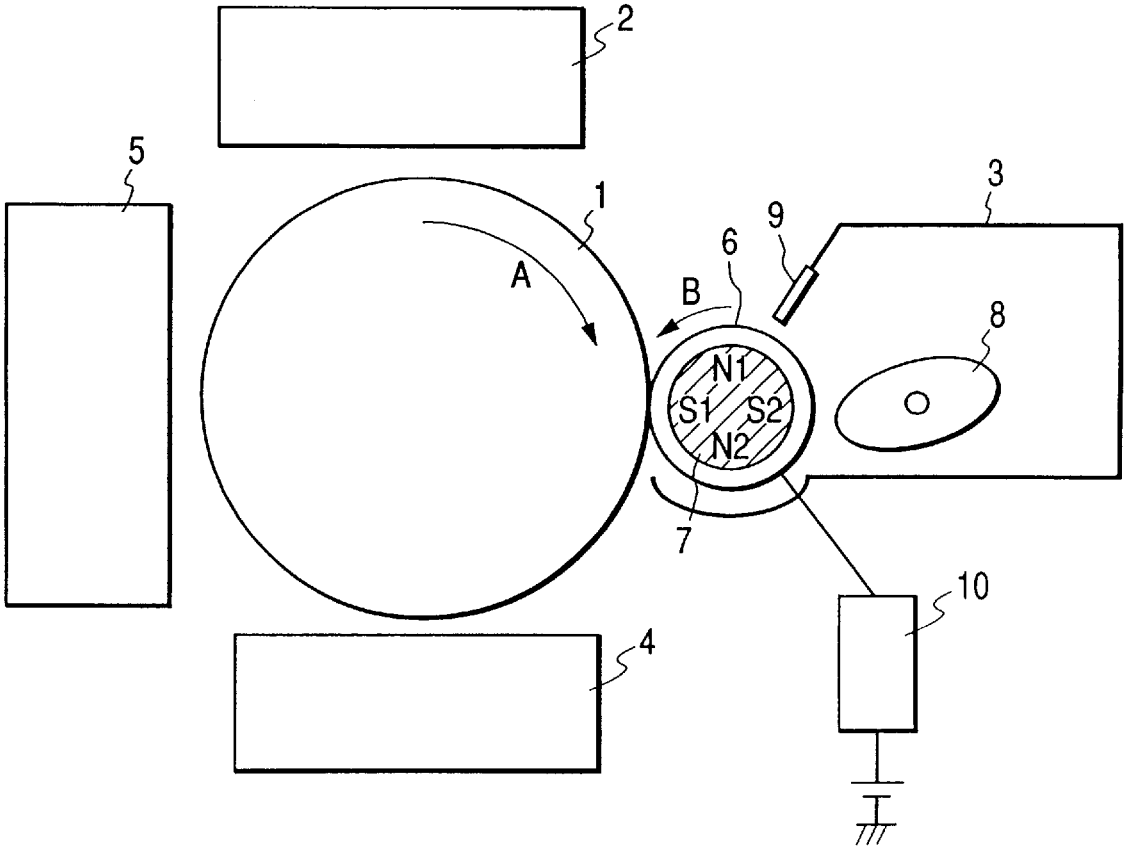
FIG. 1 is a schematic structural view showing an embodiment of an image forming apparatus according to the present invention.

FIG. 1 is a schematic structural view showing an embodiment of an image forming apparatus according to the present invention. In FIG. 1, reference numeral 1 designates an image bearing body, which is called an electrophotographic photosensitive drum in this embodiment. Around this photosensitive drum 1, there are provided: a latent image formation portion 2 for forming an electrostatic latent image on the surface of the photosensitive drum 1; a developer device 3 for developing the latent image; a transfer and separating portion 4 for transferring a toner image obtained by development onto a transfer medium, and separating the transfer medium from the photosensitive drum 1; and a cleaning portion 5 for cleaning the toner remaining on the photosensitive drum 1 after the transfer.

In order to form an image, the photosensitive drum 1 is rotated in a direction indicated by an arrow A, the surface of the photosensitive drum 1 is first charged by the latent image formation portion 2, and the image is exposed to form an electrostatic latent image. The latent image formed on the photosensitive drum 1 is moved to the position of the developer device 3 with the rotation of the photosensitive drum 1 to be developed by the developer device 3 using developer. As the developer, magnetic toner prepared by dispersing magnetic particles in resin is used in this embodiment.

According to this embodiment, the developer device 3 contains positively-chargeable magnetic toner therein. The developer device 3 comprises: a non-magnetic development sleeve 6 as a developer bearing body for conveying toner to a development unit opposite to the photosensitive drum 1 by carrying the magnetic toner to rotate in a direction indicated by an arrow B; a magnet roller 7 as magnetic field generating means nonrotatably arranged within the development sleeve 6; agitation means 8 for agitating and mixing new and old toner within the developer device 3 and conveying the toner to the development sleeve 6; a magnetic blade 9 for regulating the layer thickness of the toner carried on the development sleeve 6; and a bias power source 10 for applying a development bias to the development sleeve 6. The development sleeve 6 is arranged spaced apart a predetermined minimum clearance from the photosensitive drum 1 facing thereto. The magnet roller 7 has four magnetic poles: N1, S1, N2 and S2.

The magnetic blade 9 is arranged spaced apart a predetermined clearance from the magnetic pole N1 of the magnet roller 7 within the development sleeve 6 facing thereto to regulate the layer thickness of the toner carried on the development sleeve 6 by means of a magnetic field formed between the magnetic blade 9 and the magnetic pole N1 (regulation pole). The toner conveyed to the development unit after the layer thickness is regulated is caused to stand erect high on the surface of the development sleeve 6 by the magnetic pole S1 (development pole) of the magnet roller 7 arranged in the development unit. The toner which stands erect high is caused to fly and adhere to the latent image portion by means of a potential difference between the latent image on the photosensitive drum 1 and the development sleeve 6 to develop the latent image as a toner image.

In order to promote the development at this time, a development bias in which AC voltage is superimposed on DC voltage is applied between the development sleeve 6 and the photosensitive drum 1 by the bias power source 10. The toner on the development sleeve 6 flies by means of the development bias to repeat adhesion to and separation from the photosensitive drum 1, and until the latent image portion on the surface of the photosensitive drum 1 leaves the development unit, the toner adheres to the latent image portion correspondingly to the potential of the latent image for remaining to thus develop the latent image satisfactorily.

The toner image thus formed on the photosensitive drum 1 is transferred onto a transfer medium (not shown) supplied to the photosensitive drum 1 at the transfer and separating portion 4. The transfer medium is separated from the photosensitive drum 1 while the toner image is being transferred from the photosensitive drum 1 by the transfer and separating portion 4, and thereafter, is conveyed to a fixing unit by conveying means (not shown) to fix the toner image onto the transfer medium by fixing there. After the transfer is terminated, the photosensitive drum 1 has the toner remaining on the surface thereof removed by the cleaning portion 5, and prepares for formation of a latent image for the next image.

Figure 2:
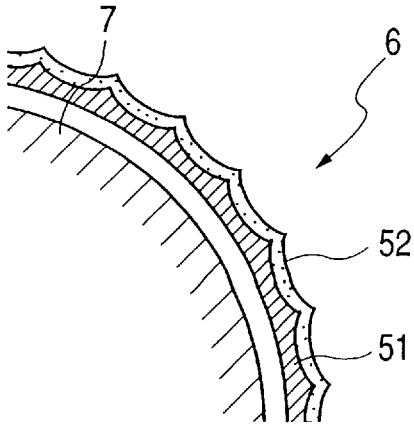
FIG. 2 is a cross-sectional view showing a surface portion of the development sleeve in a developing apparatus provided in the image forming apparatus of FIG. 1.

An example of specifications for an apparatus according to this embodiment is as follows:

- The magnetic force (on the surface of the development sleeve) at the magnetic pole of the magnet roller: N1=850 gauss, S1=950 gauss, N2=750 gauss and S2=550 gauss
- Shortest distance between photosensitive drum and development sleeve: 230 $\mu$m
- Distance between development sleeve and magnetic blade: 240 $\mu$m
- Development bias: DC voltage + AC voltage. DC voltage=+250 V, AC voltage=peak-to-peak voltage 1.3 kV, frequency 2.7 kHz, duty 35%
- Photosensitive drum: a-Si. Dark portion potential=+400 V, Light space potential=+50 V
- Image formation speed: A4-size 40 sheets/minute
- Rotating speed of photosensitive drum: 260 mm/sec
- Rotating speed of development sleeve: 1.5 times the rotating speed of the photosensitive drum The present invention is significantly characterized by the structure of the development sleeve 6 in the developer device 3. As shown in FIG. 2, the development sleeve 6 is constructed such that (1) the sleeve base member 51 made of comparatively-low hardness nonmagnetic metallic material is subjected on the surface to the blasting treatment using spherical particles, and (2) an electroless plating layer 52 having higher hardness than the base member 51 is formed on the surface thereof.

Even if, however, (1') the blasting treatment using spherical particles is performed irrespective of the hardness of the metallic material for the sleeve, and (2') an electroless plating layer is formed on top thereof, it has the effect against the sleeve contamination better than before.

More specifically, the structure of the above-described (1)+(2) system is more effective for the sleeve contamination than the structure of the above-described (1')+(2') system, and is also more excellent in the maintenance of the image density as the result. In the following description, the structure of the above-described (1)+(2) system will be described. The differences in the effect between (1), (1') and (2), (2') will be described in the description of the following embodiments.

In this embodiment, the sleeve base member 51 is made of aluminum alloy (A6063), and has a wall thickness of 0.65 $\mu$m, and an outer diameter of 32 mm. The plating layer 52 is formed by electroless Ni-P plating.

The present inventors found that the above-described structure of development sleeve, that is, (1) to use the sleeve base member 51 made of comparatively-low hardness nonmagnetic metallic material for performing the blasting treatment using spherical particles on the surface thereof, and (2) to form a comparatively-high hardness electroless plating layer 52 having higher hardness than the base member 51 on the surface thereof are effective particularly to reduce the sleeve contamination. The description will be made below.

In this embodiment, the blasting treatment using spherical particles was performed on a comparatively-low hardness nonmagnetic metallic sleeve having Vickers hardness Hv=about 50 to 150. As the nonmagnetic metallic material, there are copper alloy such as aluminum alloy and brass, and the like, but since it is advantageous in respect of the cost, the aluminum alloy was used. The sleeve was subjected to centerless polishing before the blasting treatment. As a comparative example, a sleeve made of SUS316 (Hv=about 180), which is comparatively-high hardness non-magnetic metallic material, was subjected to the blasting treatment using spherical particles similarly.

Since this embodiment and the comparative example have sleeves having different hardness, an attempt was made to have surface roughness Rz (10-point mean roughness), Ra (center line mean roughness) and the like, which are almost the same, by varying the blasting condition. The surface roughness Rz of the development sleeve and the like were made almost the same in terms of securing the same toner conveying ability between this embodiment and the comparative example.

Concretely, as regards the aluminum sleeve, abrasive grains having a fixed form (spherical or spherical, flat particles whose surface is smooth are preferable), preferably glass beads having particle sizes of Numbers #100 to #800 (specified in JIS) can be used for abrasive grains which are blasting material. In this embodiment, glass beads #300 were used. Four blasting nozzles having a diameter of 7 mm were prepared, and they were located at a distance of 150 mm from the sleeve at intervals of 90° around the sleeve. The sleeve was caused to rotate at 36 rpm, and the glass beads were blown against through the nozzles at air pressure (blasting pressure) of 2.5 kg/cm$^2$ for nine seconds while the nozzles are being moved in parallel with the sleeve shaft. The nozzles were moved in a configuration in which they were upwardly inclined toward each other with respect to the sleeve shaft for blasting.

In the case of the SUS sleeve, the same conditions as described above were applied except for the blasting pressure of 4.0 kg/cm$^2$.

As described above, the sleeve surface was caused to be subjected to the blasting treatment to obtain a roughened surface. After the blasting treatment was terminated, the development sleeve was dried after the surface was washed.

Table 1 shows the roughness and the like of the surfaces (blasted surfaces) of the aluminum alloy sleeve and the SUS sleeve which have been subjected to the blasting treatment. Also, FIG. 3 is a view obtained by observing with a light microscope the blasted surface of the aluminum alloy sleeve, and FIG. 5 is a similar view for the blasted surface of the SUS sleeve.

TABLE 1

| Sleeve material, surface treatment | Blasting pressure (kg/cm$^2$) | Roughness (μm) RZ | Roughness (μm) Ra | Average thread interval Sm (μm) |
|---|---|---|---|---|
| Al alloy + blasting | 2.5 | 3.9 | 0.55 | 42 |
| SUS + blasting | 4.0 | 3.6 | 0.50 | 39 |

Figure 3:
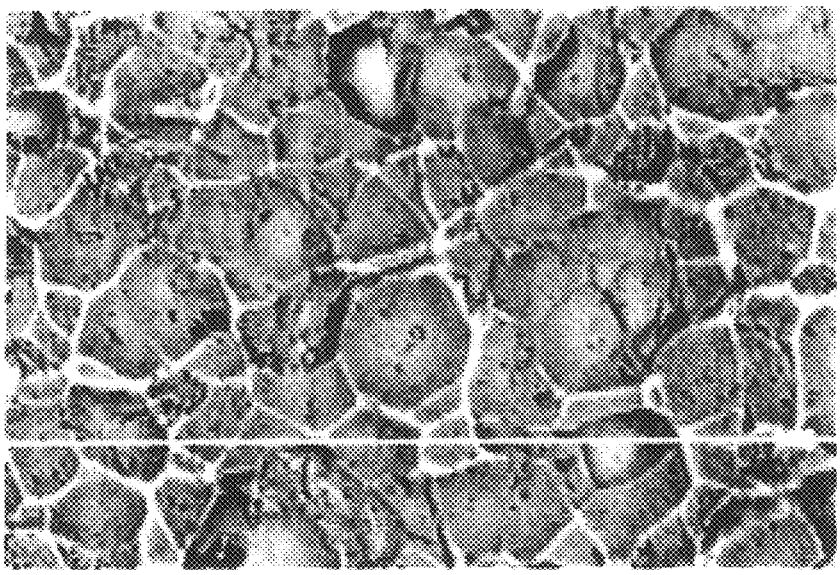
FIG. 3 is an observation view by a light microscope for the sleeve surface when an aluminum sleeve is subjected to the blasting treatment using glass beads.
Figure 5:
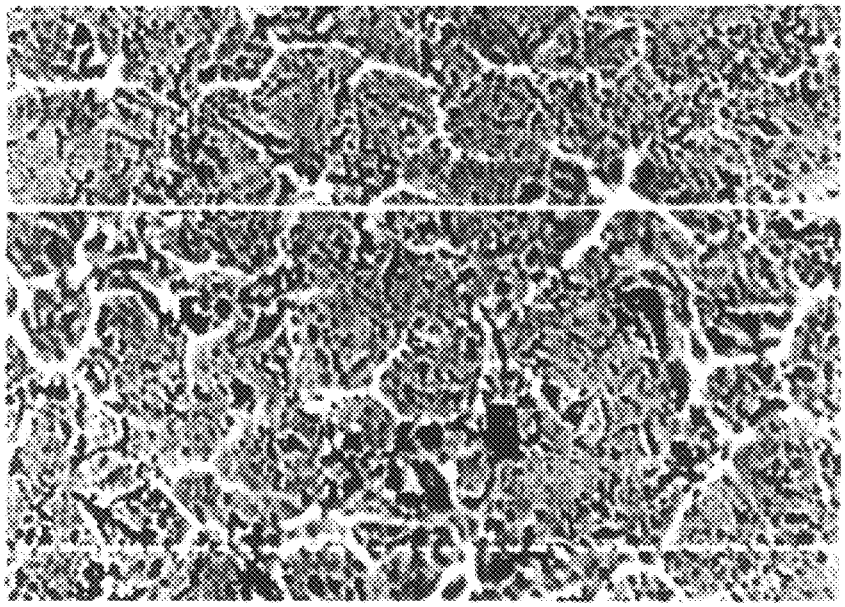
FIG. 5 is an observation view by a light microscope for the sleeve surface when an SUS sleeve is subjected to the blasting treatment using glass beads.

As will be apparent from FIGS. 3 and 5, the blasted surfaces for the aluminum alloy sleeve and the SUS sleeve have different aspects although they are almost the same in roughness Rz and the like as shown in Table 1. More specifically, when a comparatively-low hardness aluminum sleeve is subjected to the blasting treatment, the asperities on the surface are uniformly finished, and there are few minute concave portions and holes such as cracks within each concave portion. In contrast, in the case of a high-hardness SUS sleeve, highly uniform asperities could not be obtained on the surface by the blasting treatment, but there are many minute concave portions and holes such as cracks within each concave portion.

Figure 4:
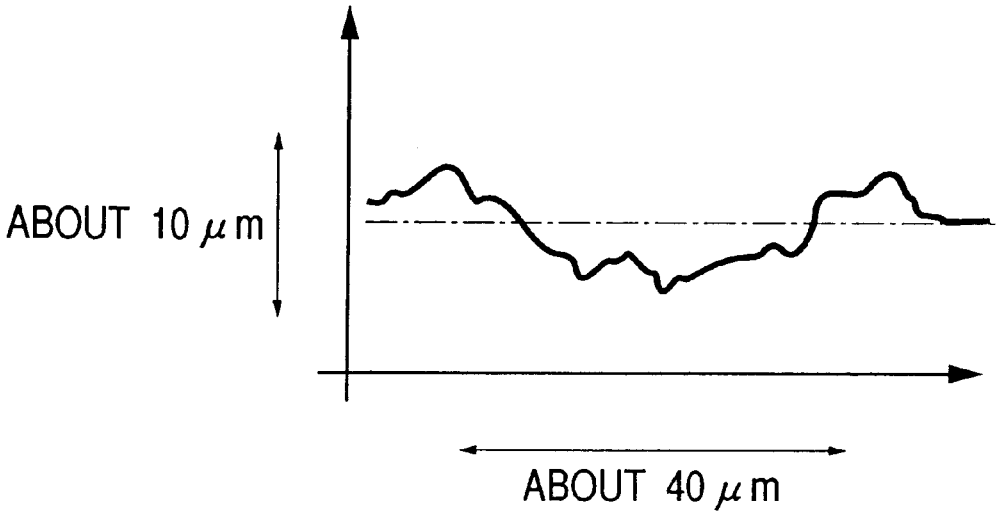
FIG. 4 is a schematic view showing the roughness profile curve for the sleeve surface of FIG. 3.
Figure 6:
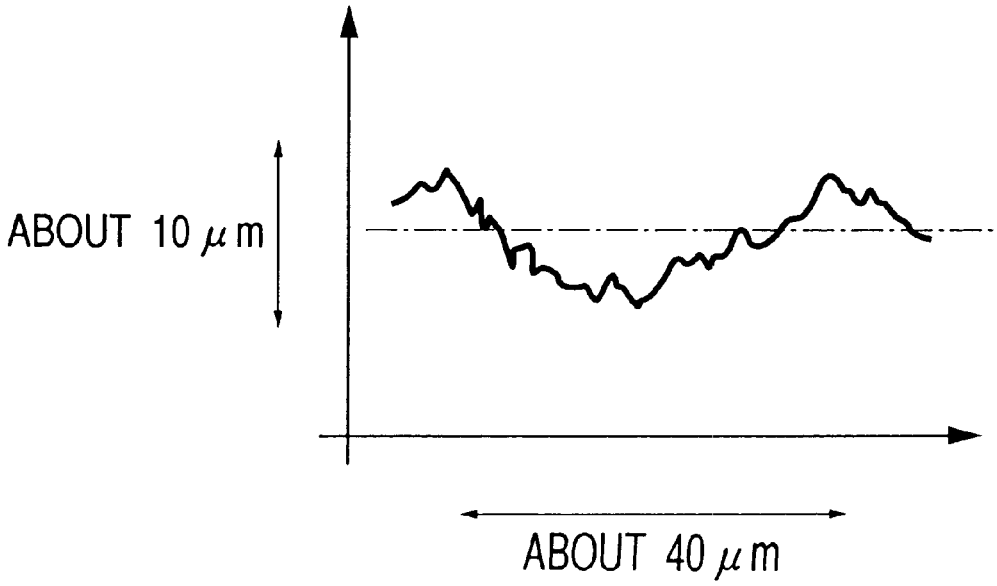
FIG. 6 is a schematic view showing the roughness profile curve for the sleeve surface of FIG. 5.

Such difference in surface property is difficult to appear in the numerical values obtained by calculating the average value for surface roughness such as Ra and Rz, and is also difficult to be reflected in the average thread interval Sm and the like. When the difference between FIGS. 3 and 5 is represented by a schematic view for roughness profile curve, it is considered to be as shown in FIGS. 4 and 6. FIG. 4 shows that such crater-shaped concave portions as obtained by a collision of spherical particles are comparatively systematically formed, while FIG. 6 shows that although there are crater-shaped concave portions, there exist many minute concave portions and holes such as cracks inside the concave portions.

The formation of such crater-shaped concave portions and microscopic concave portions within those concave portions is considered as below. In a case where glass beads collide with the sleeve surface in the blasting treatment, when a certain bead collides at a position deviated from the position where its previous bead collided, and the next bead, its next bead, and other beads continue to collide, a place where a deformed portion (concave portion) caused by the first bead and a deformed portion by another bead overlap one another is distorted to form microscopic asperities of cracks, accordingly microscopic concave portions at that portion. Thereafter, when further other beads intensively collide, crater-shaped concave portions are formed while disappearance of microscopic concave portions and formation of new microscopic concave portions are taking place, and crater-shaped concave portions having microscopic concave portions inside appear. The crater-shaped concave portions are first formed, and even if the next bead, its next bead and other beads collide there, crater-shaped concave portions having microscopic concave portions inside appear.

Also, in the case of the aluminum sleeve, since the material is soft, there is the strong tendency that microscopic concave portions caused by a collision of beads are vanished by a collision of other beads, while in the case of the SUS sleeve, since the material is hard, the microscopic concave portions are not vanished by a collision of other beads, but easily remain. For this reason, any blasted surface having highly-uniform asperities cannot be obtained in the SUS sleeve, and it seems that there might be many microscopic concave portions within the crater-shaped concave portions. By keeping the blasting pressure low, it is possible to form a blasted surface having high uniformity even in the SUS sleeve, but in this case, Ra and Rz will be lowered, which is not desirable in view of the toner conveying ability.

Most of such microscopic concave portions have a diameter of 5 μm or less, and their depth is considered to be several μm although it is not clearly known.

As the particle diameter of toner is reduced, the small-diameter toner described above is imbedded in such microscopic concave portions which have comparatively not presented a problem so far, and in the case of the SUS sleeve, there are many microscopic concave portions to cause the sleeve contamination, and the aluminum sleeve is considered to be more highly resistant to contamination.

Figure 14:
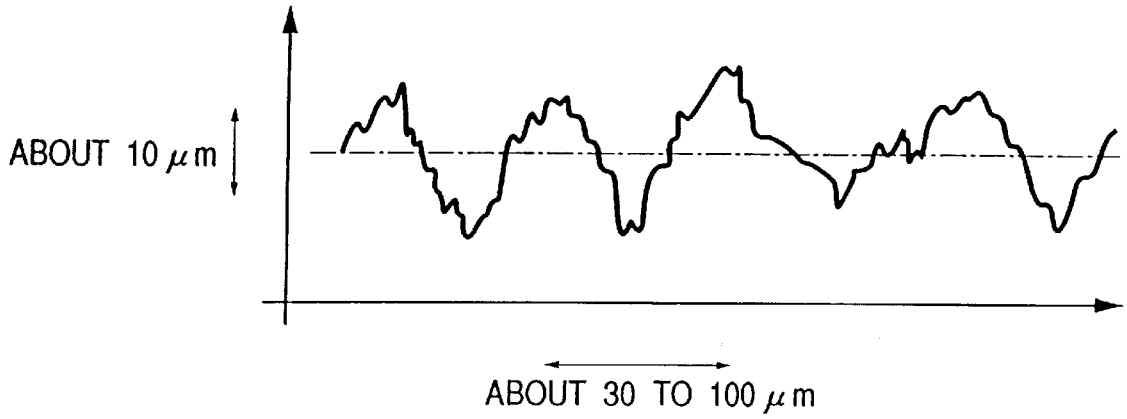
FIG. 14 PRIOR ART
FIG. 14 is a schematic view showing the roughness profile curve for the sleeve surface when a conventional SUS sleeve is subjected to the blasting treatment using Alundum.
Figure 15:
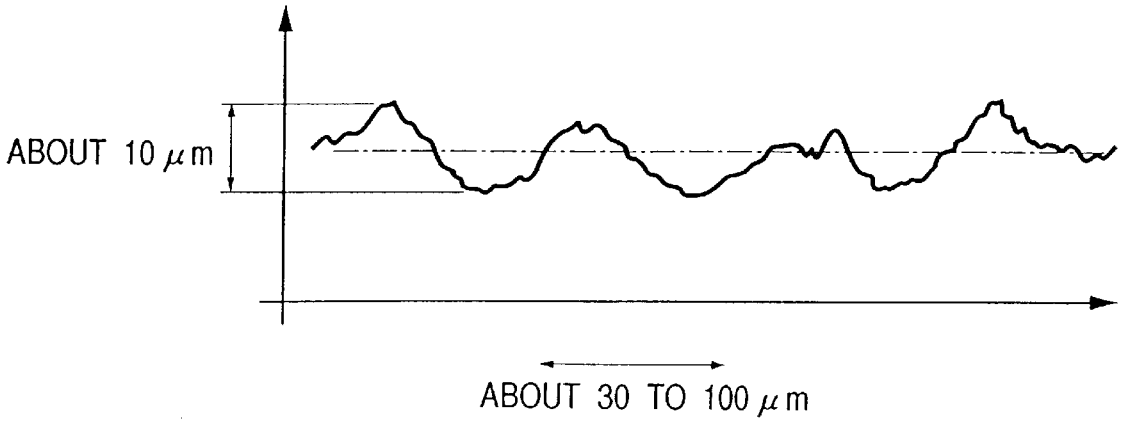
FIG. 15 PRIOR ART
FIG. 15 is a schematic view showing the roughness profile curve for the sleeve surface when a conventional SUS sleeve is subjected to the blasting treatment using glass beads.
Figure 16:
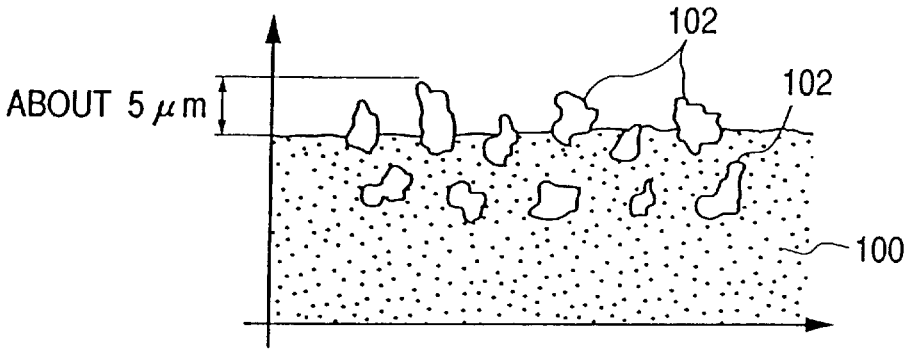
FIG. 16 PRIOR ART
FIG. 16 is a cross-sectional view showing the surface of a carbon-coated sleeve coated with resin containing conventional carbon.
Figure 17:
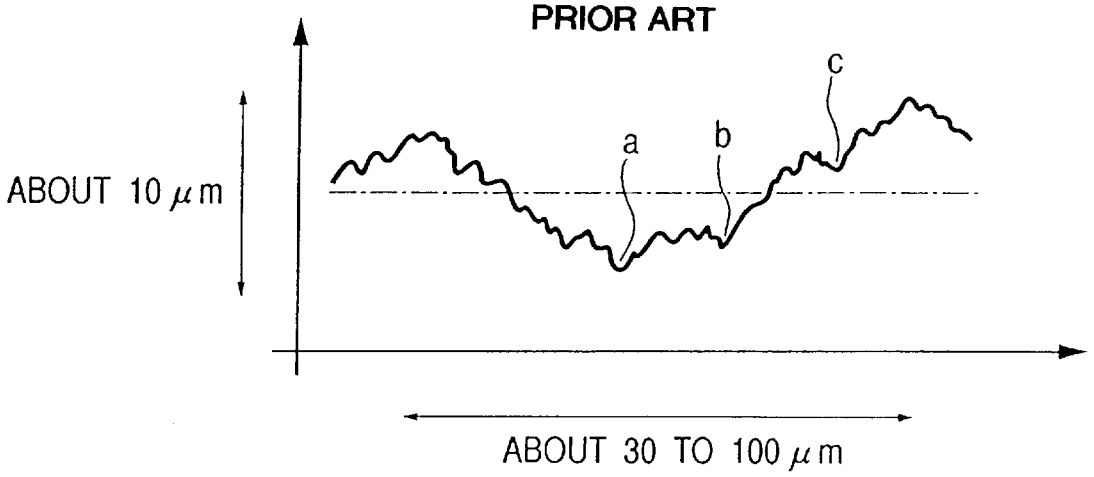
FIG. 17 PRIOR ART
FIG. 17 is an enlarged view showing the asperities in the roughness profile curve on the sleeve surface of FIG. 15.

The SUS sleeve subjected to the blasting treatment using the spherical particles is much more difficult to cause the sleeve contamination than the SUS sleeve (FIG. 14) subjected to the Alundum blasting treatment of the conventional example, but in consideration of the use of smaller particle diameter toner in recent years, the prevention of sleeve contamination is still insufficient, and is particularly insufficient when positive toner is used.

In this respect, such a difference in uniformity in crater-shaped concave portions is attributed to the following reason.

During blasting, other beads successively hit other places than the place which the first blasting bead hits, but the last one bead which hits greatly contributes to the formation of such a crater-shaped shape. For this reason, a fine concave portion can be made only by a hit of the last one bead with aluminum or the like which is soft material, whereas a fine concave portion cannot be made by one bead with hard SUS, and therefore it is considered that it might be inferior in uniformity.

Also, it is considered that the SUS has more microscopic cracks within the concave portion because of the hardness of the material. In other words, in order to obtain the same roughness, the SUS requires higher blasting pressure than for aluminum, and therefore, it is considered that the SUS has higher stress on the material surface to cause cracks such as microscopic defects to easily occur. Of course, as described above, a fine surface to some extent can be made even with the SUS if the blasting pressure is reduced, but in this case, the roughness lowers, which is not suitable for the sleeve in view of toner conveying ability.

Even with the SUS sleeve, however, if the blasting treatment is performed with slightly higher blasting pressure in order to secure the roughness to some extent, accordingly even if many microscopic cracks and the like may occur on the surface, it will be able to exhibit the effect against the sleeve contamination if the conditions for electroless plating treatment to be described next are properly selected. This will be described later.

The foregoing is considered to be reasons why it will advantageously act to reduce the sleeve contamination to use a sleeve base member made of (1) comparatively-low hardness non-magnetic metallic material, and to cause it to be subjected to the blasting treatment using spherical particles.

Next, the reason for (2) performing comparatively-high hardness electroless plating will be described.

A sleeve prepared by performing the spherical blasting treatment on the above-described aluminum will be described. The plating is electroless Ni-P plating.

The electroless Ni-P plating process will be briefly described. In continuation of washing and degreasing of a sleeve surface subjected to the blasting treatment, pretreatment for formation of zinc alloy coat using zincate process is performed, and thereafter, Ni-P electroless plating (chemical Ni plating using common name "Kanizen") containing 2 to 15 wt % of P is performed. The plating thickness was about 5 $\mu$m. As the post-treatment, no heat treatment was performed. Although the hardness of the plating coat is about Hv=450 since no heat treatment was performed, sufficient durability, i.e., wear resistance was obtained as the plating coat for the development sleeve. As regards the hardness and wear resistance, they will be described again in the experimental example, and it had more excellent wear resistance than SUS316. The heat treatment may be performed as required, and the hardness can be increased to about Hv=1000 by, for example, heating aging. Since the eccentricity (warpage) of the sleeve becomes great depending upon its thickness, attention should be given on aging. Also, the magnetic properties also tend to be restored by aging.

As regards the hardness and wear resistance, they will be described again in the experimental example, and it had better results than SUS316 (Hv=about 180) because Ni-P plating having about Hv=450 was used.

Figure 8:
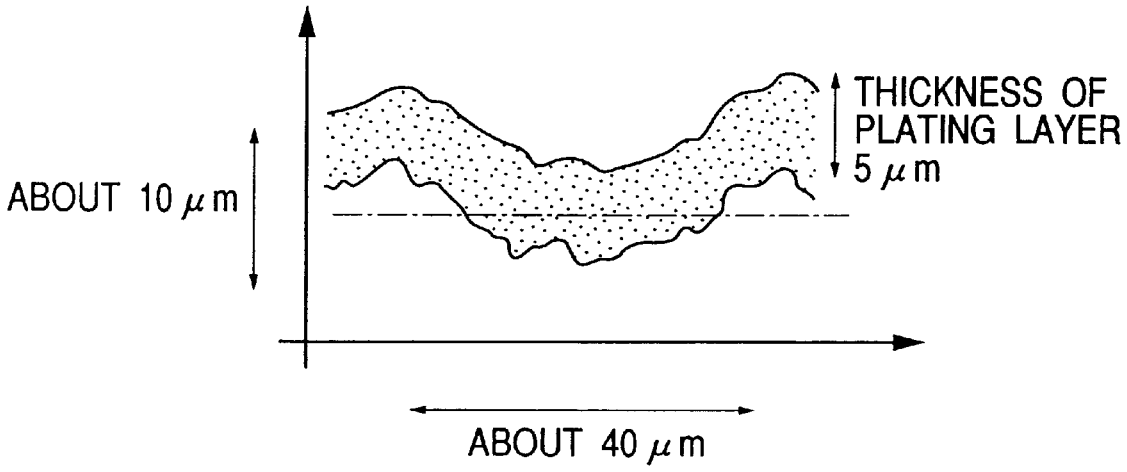
FIG. 8 is a schematic view showing the roughness profile curve for the sleeve surface of FIG. 7.

FIG. 8 is a schematic view showing a roughness profile curve for the sleeve surface when the electroless Ni-P plating is performed on the above-described aluminum sleeve (FIGS. 3 and 4) subjected to glass beads blasting treatment. The aluminum sleeve subjected to the blasting treatment has few microscopic asperities within crater-shaped concave portions on the surface from the beginning as described above because the material has comparatively low hardness. Since Ni-P plating was performed at a thickness of about 5 $\mu$m on the surface, it is considered that the plating layer specularly covers the crater-shaped concave portions to imbed in the microscopic concave portions as shown in FIG. 8. Therefore, the effect of preventing the sleeve contamination is considered to be further better.

Figure 7:
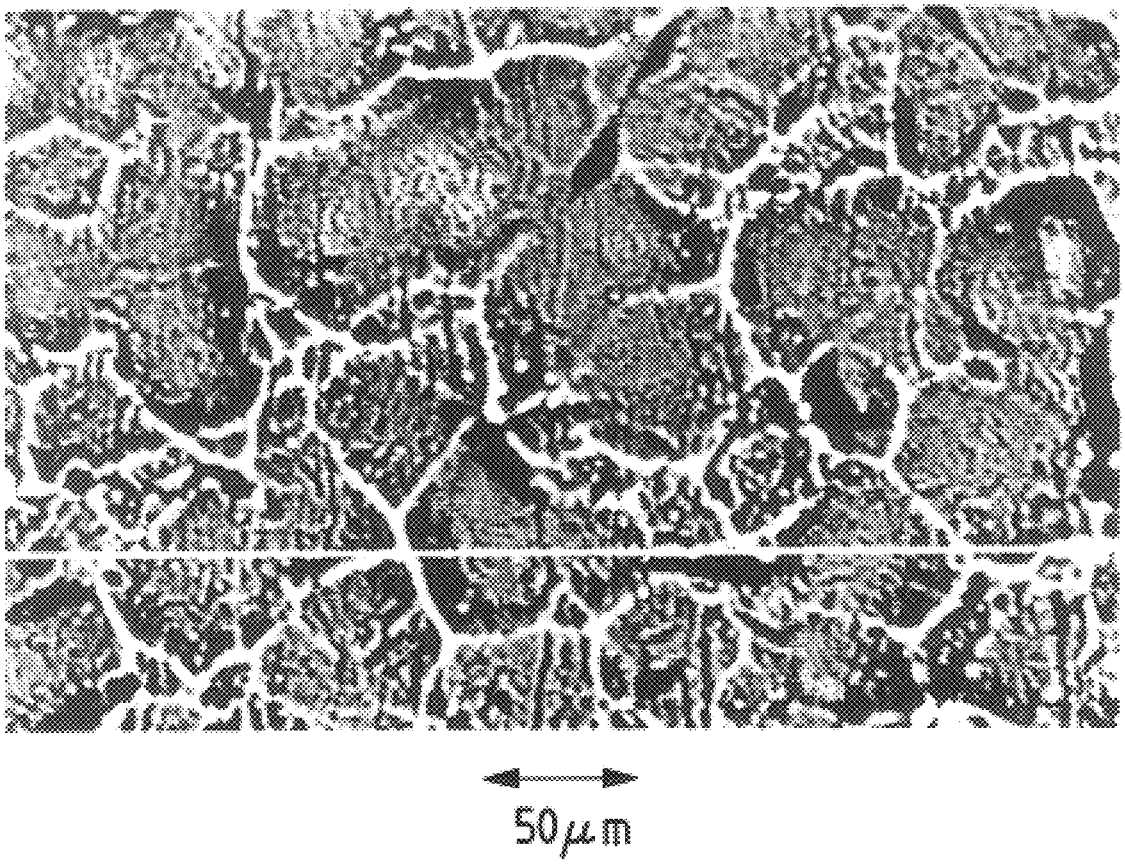
FIG. 7 is an observation view by a light microscope for the sleeve surface when electroless Ni-P plating is performed on the surface subjected to the blasting treatment in the aluminum sleeve of FIG. 3.

The surface of the aluminum sleeve subjected to electroless Ni-P plating after the above-described blasting treatment is observed with a light microscope as shown in FIG. 7. Although it is difficult to see since it is seen through the aluminum surface under the plating layer, it is considered that the microscopic concave portions within the crater-shaped concave portions on the aluminum surface might have been imbedded with the plating layer.

Particularly, toner having a particle diameter (volume average) of 7 $\mu$m is used in the following embodiment, and since toner having as small a diameter as about 4 $\mu$m or less is prone to be imbedded in microscopic cracks, it is considered effective for countermeasures against the sleeve contamination to bury such cracks as shown in FIG. 8.

When electroless Ni-P plating is performed, the microscopic concave portions within the crater-shaped concave portions will disappear as described above. Since, however, the plating layer is formed after the crater-shaped concave portion, the roughness Rz, Ra, average thread interval Sm and the like for the surface plated are not much different from when the aluminum was subjected to the blasting treatment as shown in Table 2. Therefore, the toner conveying ability and the like are not deteriorated.

TABLE 2

| Sleeve material, surface treatment | Roughness ($\mu$m) Rz | Ra | Average thread interval Sm ($\mu$m) | Hardness Hv |
|---|---|---|---|---|
| Al alloy + blasting | 3.9 | 0.55 | 42 | About 100 |
| Al alloy + blasting + Ni—P plating | 3.8 | 0.56 | 41 | About 450 |

As described above, a development sleeve subjected to the surface treatment according to the present invention has suitable surface property for the sleeve contamination or the like. Concerning this fact, the surface roughness profile curves presented so far illustrate the reason, and the fact cannot be sufficiently grasped by the surface roughness Ra and the like which are conventional indexes. Anyway, it is evident also from the following experimental examples that the surface treatment according to the present invention is effective for the sleeve contamination and the like.

In the present invention, electroless plating is used instead of electroplating. This is partly because the electroless plating is chemical plating and therefore, it is possible to adhere plating metal separated out onto a roughened, uneven surface of the development sleeve 6 at a uniform thickness irrespective of the unevenness for obtaining a plating coat with a uniform thickness, and partly because the surface roughness obtained by roughening can be maintained almost the same. In the electroplating, it is difficult for plating metal to separate out on the concave portions on a roughened surface of the development sleeve, and the plating metal preferentially adheres to convex portions so that only the convex portions are plated thick. Therefore, any uniformly-thick plating coat cannot be obtained to thereby change the surface roughness.

The electroless plating has various plating metals, and there are mentioned, for example, the above-described electroless Ni-P plating, electroless Ni-B plating, electroless Pd-P plating, electroless Cr plating and the like.

As described above, as the physical property for the sleeve surface, it is desirable that there is provided a magnet roller within the sleeve and it is nonmagnetic in the case of magnetic one-component development using magnetic toner, and therefore, electroless Ni-P plating, electroless Ni-B plating, electroless Pd-P plating and the like are desirable. Since, however, the plating thickness is 5 to about 25 μm, or preferably 3 to 20 μm, Cr plating actually does not disturb the magnetic field by the magnet within the development sleeve on the surface of the development sleeve even in Cr plating on ferromagnetic material, but can be used on the surface thereof. However, the magnetism will be restored if annealed.

Also as regards the Ni-P plating, although it is also ferromagnetic material alone, nickel (Ni) combines with phosphorus (P) or boron (B) in an electroless Ni-P or Ni-B plating layer to thereby become amorphous substance and nonmagnetic. The phosphorus content in the Ni-P plating coat required to become thus nonmagnetic is 5 to 15 wt %, or preferably 8 to 10 wt %, and the boron content in the Ni-B plating coat is 2 to 8 wt %, or preferably 5 to 7 wt %.

The plating may be uniformly performed over the entire surface of the development sleeve 6, but it can be made like any apertured-shaped mesh by plating after mesh-shaped masking treatment.

As described above, according to the present invention, the structure can be arranged such that (1) a sleeve base member made of comparatively-low hardness nonmagnetic metallic material is used, this base member is caused to be subjected to the blasting treatment using spherical particles, and (2) after the blasting treatment, comparatively-high hardness electroless plating is performed to thereby increase the hardness in the surface of the sleeve base member. Therefore, it is possible to provide a durable development sleeve with its wear resistance improved, having the high effect of preventing the sleeve contamination, thus making it possible to implement an image forming apparatus which will have no deteriorated density due to development even during long-term use.

Hereinafter, the toner used in the present invention will be described. The toner is magnetic toner in this embodiment.

The particle diameter of the magnetic toner is 4 to 10 μm in particle diameter in volume average, or preferably 4 to 8 μm. When the particle diameter in volume average of toner is 4 μm or less, it is difficult to control the toner, and when the toner is used for use application with high image area ratio such as a graphic image, there easily arises a problem that the toner on the transfer medium hardly spreads well to cause the image density to become low. When the particle diameter in volume average of toner is 10 μm or more, resolution for thinn lines is not good, but deteriorated image quality is prone to occur in due course even if good at the beginning of image formation. In this embodiment, toner of 7 μm in particle diameter in volume average was used.

The particle size distribution of toner can be measured by various methods, but in the present invention, it was measured using a Coletar counter TA-II (manufactured by Coletar Inc.). To the Coletar counter, there was connected a personal computer CX-i (manufactured by Canon K. K.) for outputting number distribution or volume distribution of toner. For the electrolyte, 1% NaCl water solution was prepared using sodium chloride class 1.

Into 100 to 150 ml of electrolyte, 0.1 to 5 ml of surface-active agent, or preferably alkyl benzenesulfonate is added as dispersant, and further 2 to 20 mg of magnetic toner is added as the measuring sample. The electrolyte in which this measuring sample is suspended is dispersed by an ultrasonic dispersion apparatus for about 1 to 3 minutes, the particle size distribution for toner particles of 2 to 40 μm was measured with the number as a reference using a 100 μm aperture at the Coletar counter to determine the volume particle size distribution from it. As regards toner of particle diameter in volume average of 7 μm here, an amount of fine powder of 4 μm or less is assumed to be 20% or less in number, and an amount of coarse powder of 15 μm or more is assumed to be 5% or less in volume.

The true density of magnetic toner is preferably 1.45 to 1.70 g/cm$^3$, or more preferably 1.50 to 1.65 g/cm$^3$. The magnetic toner within this range is capable of exhibiting the maximum effects in respects of high image quality, durability and stability. When the true density of the magnetic toner is less than 1.45, the magnetic toner particle itself is too light in weight, and is prone to cause collapse of thin lines due to reversal fog and excessive spread of toner particles, scattering, and deteriorated resolution. When the true density of the magnetic toner exceeds 1.70, an image free from high-contrast sharpness such as low image density and interrupted thin lines is given. Also, since the toner magnetic force becomes relatively higher, the height of the toner will become long or become divergent, and the image is prone to become turbulent and rough in the quality in development.

There are several methods to measure the true density of the magnetic toner, but the present invention adopted the following method capable of correctly and simply measuring the true density of fine powder.

The following are prepared: a cylinder made of stainless steel having inside diameter of 10 mm and length of about 5 cm, a disk (A) having an outside diameter of about 10 mm and a height of 5 mm which can be inserted in the cylinder into tight contact therewith, and a piston (B) having an outside diameter of about 10 mm and a length of about 8 cm. The disk (A) is put into the bottom of the cylinder, about 1 g of magnetic toner is put therein as the measuring sample, and then the piston (B) is slowly pressed in. A force of 400 kg/cm$^2$ is applied to the piston (B) by a hydraulic press to compress the toner. After this compressed state is maintained for five minutes, the toner is taken out.

The weight W(g) of this compressed sample is weighed, and the diameter D (cm) and the height L (cm) thereof are measured by a micrometer, and the true density of the magnetic toner is calculated by the following equation:

$$\text{True density}(g/cm^3)=W/\{\pi\times(D/2)^2\times L\}$$

In order to obtain better development property by magnetic toner, the magnetic toner preferably has residual magnetization as of 1 to 5 emu/g, more preferably 2 to 4.5 emu/g, saturation magnetization σs of 20 to 40 emu/g, and magnetic characteristic of 40 to 100 oersted (Oe) in high magnetic force Hc.

In the present invention, as toner binder (binding resin), the following resin can be used in consideration of the use of a heating and pressing roller fixer for oil coating:

There can be used, for example, styrene and homopolymer of its substitution product such as polystyrene, poly-p-chlorostyrene, and polyvinyltoluene; styrene copolymer such as styrene-acryl copolymer, styrene-p-chlorostyrene copolymer, styrene-vinyltoluene copolymer, styrene-vinylnaphthalene copolymer, styrene-acrylate ester copolymer, styrene-methacrylate ester copolymer, styrene-α-chloromethyl methacrylate copolymer, styrene-acrylonitrile copolymer, styrene-vinylmethyl ether copolymer, styrene-vinylethyl ether copolymer, styrene-vinylmethyl ketone copolymer, styrene-butadiene copolymer, styrene-isoprene copolymer and styrene-acrylonitrile-indene copolymer; and polyvinyl chloride, phenolic resin, natural modified phenolic resin, natural resin modified maleic acid resin, acrylic resin, methacrylate resin, polyvinyl acetate, silicone resin, polyester resin, polyurethane, polyamide resin, furan resin, epoxy resin, xylene resin, polyvinyl butyral, terpene resin, coumarone and indene resin, petroleum resin and the like. In this embodiment, styrene acryl copolymer was used as toner binder.

In a heating and pressing roller fixer of a type in which oil is hardly coated, the important issues are so-called offset phenomenon in which a part of a toner image on a transfer medium transfers onto the roller, and adhesion of the toner on the transfer medium. The toner which fixes with less heat energy has usually the property to easily cause blocking or caking during preservation or in a developer unit, and therefore, these problems must be also taken into consideration at the same time.

The physical properties of the toner binder are most significantly related to these problems. When the content of the magnetic material within the toner is reduced, the adhesion on the transfer medium is improved during fixing, but the offset becomes prone to occur, and the blocking or caking also easily occurs.

For this reason, when the heating and pressing roller fixer of a type in which oil is hardly coated is used, it is important to select the toner binder, and as a preferred binder, cross-linked styrene copolymer or cross-linked polyester is used.

As co-monomer to styrene monomer of this styrene copolymer, vinyl monomer such as the following can be used independently or in a combination of two or more: monocarboxylic acid having double bond or its substitution product such as, for example, acrylic acid, methyl acrylate, ethyl acrylate, butyl acrylate, dodecyl acrylate, octyl acrylate, 2-ethylhexyl-acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acid having double bond or its substitution product such as, for example, maleic acid, butyl maleic acid, methyl maleic acid, and dimethyl maleic acid; vinyl ester group such as, for example, vinyl chloride, vinyl acetate and vinyl benzoate; ethylene olefin group such as, for example, ethylene, propylene and butylene; vinyl ketone group such as, for example, vinyl methyl ketone, and vinyl hexyl ketone; and vinyl ether group such as, for example, vinyl methyl ether, vinyl ethyl ether and vinyl isobutyl ether.

As the cross-linking agent, a compound having mainly two or more polymerizable double bonds is used. The following are used independently or in combination: for example, aromatic divinyl compounds such as divinylbenzene and divinylnaphthalene; carboxylate ester having two double bonds such as, for example, ethylene glycol diacrylate, ethylene glycol dimethacrylate, and 1,3-butanediol dimethacrylate; divinyl compounds such as divinyl aniline, divinyl ether, divinyl sulfide, and divinyl sulfone; and compounds having three or more vinyl radicals.

Also when a press fixing type fixer is used, binding resin for pressure fixing toner can be used, and examples of the binding resin include polyethylene, polypropylene, polymethylene, polyurethane elastomer, ethylene-ethylacrylate copolymer, ethylene-vinyl acetate copolymer, ionomer resin, styrene-butadiene copolymer, styrene-isoprene copolymer, and linear saturated polyester and paraffin.

The magnetic toner is preferably used by adding a charge control agent thereto, and the charge control agent can be caused to be contained in the toner particles (inner addition) or can be mixed with the toner particles (outer addition). By the use of the charge control agent, it becomes possible to perform the optimum control of the amount of charge in conformity with the development system, thus making it possible to further stabilize the balance between particle size distribution and amount of charge.

As a positive charge control agent, the following can be employed simply or as a combination of two or more kinds: denatured compound by nigrosine, triphenylmethane, fatty acid metallic salt and the like; ammonium salt Class 4 such as tributyl benzyl ammonium-1-hydroxy-4-naphthosulfonate, and tetrabutyl ammonium tetrafluoroborate; di-organo tin oxide such as di-butyl tin oxide, di-octyl tin oxide, and dicyclohexyl tin oxide; di-organo tin borate such as di-butyl tin borate, di-octyl tin borate and dicyclo tin borate. Even among these, charge control agents such as nigrosine, ammonium salt Class 4, triphenylmethane, and imidazole can be particularly preferably used.

Also,

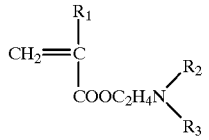

a homopolymer for monomer represented by the above general chemical formula (where $R_1$ stands for H or $CH_3$; $R_2$ and $R_3$ stand for substituted or unsubstituted alkyl radicals, preferably $C_1$ to $C_4$), or copolymerizate between this monomer and polymerizable monomer such as styrene, acrylic ester and methacrylate ester as described above can be employed as a positive charge control agent. These charge control agents also have the partial or entire action of binding resin.

As a negative charge control agent usable in the present invention, for example, organometallic complex and chelate compound are effective, and the examples of the above-described compound include aluminum acetylacetonate, iron (II) acetylacetonate, and 3,5-ditertiali-butyl chrome salicylate. Particularly, acetylacetone metallic complex, salicylic acid metallic complex or salicylic acid metallic salt, Cr complex, and Fe complex are preferable, and even among them, salicylic acid metallic complex or metallic salt is more preferable.

In this embodiment, positive toner was prepared using nigrosine.

The above-described charge control agent (having no action as binding resin) is preferably used in a finely divided particle state, and the individual average particle diameter is 4 $\mu$m or less, particularly preferably 3 $\mu$m or less.

The amount of the charge control agent to be internally added to the toner is 0.1 to 20 parts by weight to 100 parts by weight of the binding resin, or is preferably 0.2 to 10 parts by weight.

The amount of the charge control agent to be externally added to the toner is, in the case of impalpable powder silica, 0.01 to 8 parts by weight to 100 parts by weight of the toner, or is preferably 0.1 to 5 parts by weight. This silica is interposed between the toner particle and the surface of the development sleeve whereby it has also an action of noticeably reducing the wear on the development sleeve.

It is preferable to add, to the toner, impalpable powder of polymer containing fluorine such as, for example, impalpable powder of polytetrafluoroethylene, polyvinylidenefluoride and the like, or impalpable powder of tetrafluoroethylene-vinylidenefluoride copolymerizate. Particularly, polyvinylidenefluoride impalpable powder is preferable to improve the fluidity and polishing property. The amount of fluorine-containing polymer impalpable powder added to the toner is 0.01 to 2.0 wt %, particularly preferably 0.02 to 1.0 wt %.

Particularly, in the case of adding a combination of silica impalpable powder with fluorine-containing polymer impalpable powder, a state of existence of silica adhered to the magnetic toner is stabilized and the silica adhered liberates from the toner although the reason is not clear, and as a result, it becomes possible to reduce wear of the toner and contamination of the development sleeve, and to further improve the charging stability of the toner.

As abrasive material for the photosensitive drum, titanic acid strontium may be added to the toner. This abrasive material functions to prevent the toner from adhering to the surface of the photosensitive drum, and the amount added to the toner is preferably 0.01 to 1.0 wt %.

The magnetic toner may have also a role as a coloring agent, but contains magnetic material. Examples of the magnetic material contained in the magnetic toner include: iron oxide such as magnetite, γ-iron oxide, ferrite and excessive iron type ferrite; and such metal as iron, cobalt and nickel, or alloys of these metals with such metal as aluminum, cobalt, copper, lead, magnesium, tin, zinc, antimony, beryllium, bismuth, cadmium, calcium, manganese, selenium, titanium, tungsten and vanadium, and their mixtures. These are all ferromagnetic material.

The average particle diameter of these magnetic material is 0.1 to 1.0 μm, preferably about 0.1 to 0.5 μm. The content of the magnetic material in the magnetic toner is optimized in view of the development fog and density, but is generally 60 to 110 parts by weight to 100 parts by weight of resin in the toner, preferably 65 to 100 parts by weight to 100 parts by weight of resin.

Such toner is about 1.4 to 1.7 g/cm$^3$ in true specific gravity, and this is mainly determined by the above-described content of the magnetic material. Toner with low specific weight is easily developed, and therefore, the fog problem is prone to occur, while toner with high specific weight tends to cause low density. They are optimized in the development system respectively.

As regards the outer adding agent to the toner, mainly of the order of about 0.1 to 5 parts by weight of silica are externally added to impart fluidity. This silica is interposed between the toner particles and the sleeve to function so as to reduce wear on the sleeve. Also, it prevents coalescence between the toner themselves, and has also a role of promoting replacement of toner in contact with the sleeve with toner not in contact.

Further, fluorine-containing polymer such as polyvinylidene fluoride may be also externally added to the toner. Although the reason is not clear, it functions to reduce liberation of silica adhering to the toner from the toner among others, and as a result, it has the effect of improving the charging stability.

Furthermore, there may be also a case of externally adding titanic acid strontium or the like. This plays a role as abrasive material for the drum, and as a result, has the effect of polishing and removing the toner adhering to the drum like a film.

Hereinafter, the description will be made for experimental examples of image formation in this embodiment.

First Experimental Example

In accordance with this embodiment, the surface of an aluminum sleeve was roughened by the blasting treatment using glass beads #300, which are spherical particles, and thereafter electroless Ni-P plating was performed to cover microscopic asperities within concave portions on the surface. Thus, there has been obtained a development sleeve in which the concave portions on the surface have been polished to a substantially mirror-smooth state, having a plating thickness of 5 μm, and surface roughness Ra=about 0.5 μm. This development sleeve was installed in the developer device 3 as the development sleeve 6 of FIG. 1 for development to perform image formation continuously.

Figure 9:
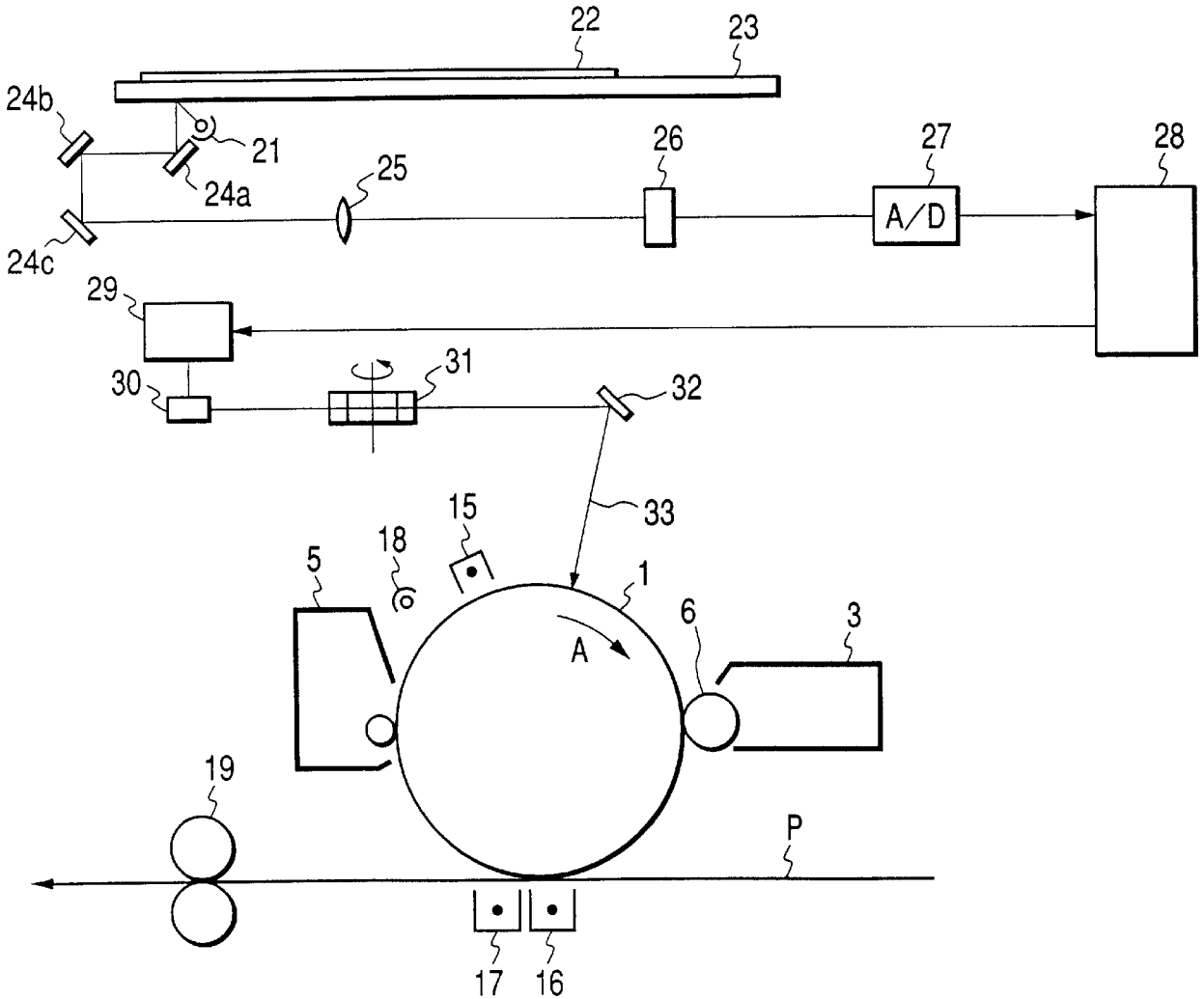
FIG. 9 is a schematic structural view showing another embodiment according to the present invention.

The present invention can be also applied to a digital copying apparatus. FIG. 9 is a schematic overall structural view showing an embodiment of a digital copying apparatus.

In this embodiment, a photosensitive drum 1 comprises a photoconductive layer of amorphous silicon provided on a cylindrical conductive base member, and is rotatably supported in a direction indicated by an arrow A. Around the photosensitive drum 1, there are arranged: a Scotron charger 15 for uniformly charging the surface of the photosensitive drum 1 along the direction of rotation; an exposure device including an exposure lamp 21, a CCD 26 and the like for reading an original 22 placed on a document glass 23 above the photosensitive drum 1 to impart image exposure 33 onto the photosensitive drum 1 on the basis of an image signal in proportion to the density of a color separation image; a developer device 3 for developing an electrostatic latent image obtained by the image exposure using positively-charged toner; a corona charger 16 for transferring a toner image formed on the photosensitive drum 1 by the development of the latent image onto a transfer medium P supplied to the photosensitive drum 1; an electrostatic separation charger 17 for separating the transfer medium P onto which the toner image has been transferred from the photosensitive drum 1; a cleaning device 5 for cleaning the surface of the photosensitive drum 1 after the toner image has been transferred to remove the remaining toner; a pre-exposure device (lamp) 18 for removing any residual charge on the surface of the photosensitive drum 1 and the like.

The transfer medium P separated from the photosensitive drum 1 is conveyed to a fixing device 19, in which the transfer medium P is heated and compressed to thereby fix the toner transferred onto an image transfer medium P, and form into a desired printed image. Thereafter, it is discharged outside the image forming apparatus.

An exposure lamp 21 in the exposure device reads an original 22 on a document glass 23 while moving along the document glass 23. The image information obtained is supplied to the CCD 26 through reflecting mirrors 24*a*, 24*b* and 24*c* which move together with the exposure lamp 21, and further a short-focus lens 25. The CCD 26 is used to convert the image information into an electric signal, and this electric signal is digitized by an A-D converter 27 to be transmitted to a signal processing unit 28. There, it is converted into a digital image signal of 256 gradations proportionate to the image density.

In the signal processing unit 28, reflected light from the original whose image has been formed on the CCD 26 is A-D converted into a luminance signal of an image of 600 dpi and 8 bit (256 gradations) to be transmitted to an image processor unit. In the image processor unit, known luminance-density conversion (Log conversion) is performed to convert the image signal into a density signal, and thereafter, the signal is caused to pass through a filtration process such as edge enhancement, smoothing and removal of high-frequency components if necessary. Thereafter, density correction process, so-called γ conversion is applied, and then is binarized (1 bit) by means of a binarization process such as, for example, the error diffusion method and the like or screening process using dither matrix of the dot concentration type. Of course, it may be possible to drive a laser in accordance with the known PWM (Pulse Width Modulation) method or the like with 8 bit to form a latent image, but binary image has been mainly used because of easy handling of image data recently. Since the data is naturally compressed into ⅛, the memory will be substantially reduced to reduce the cost in a machine having a page memory approximately for, for example, A3-size originals or in a copying apparatus having an image server storing a large amount of image data.

Thereafter, this image signal is transmitted to a laser driver 29 as a driving signal generating unit, and the laser 30 is driven depending upon the signal (by the PWM modulation system for a 8 bit image, and the laser is turned on/off for a 1 bit image). The laser light (680 nm) is irradiated to the photosensitive drum 1 as image exposure 33 through a polygon mirror 31 and a reflecting mirror 32. The image is formed on the drum with the spot diameter thereon of about 55 μm, somewhat larger than 1 pixel of 600 dpi=42.3 μm, whereby an electrostatic latent image is formed in conformity with the image signal on the photosensitive drum 1.

The copying speed of a digital copying apparatus according to this embodiment is 60 to 100 sheets per minute for A4 size.

In this embodiment, the photosensitive drum 1 was charged at a surface potential +400 V for image exposure to form a latent image at the surface potential +50 V. To the development sleeve, development bias in which DC voltage of +250 V is superimposed on a square wave (asymmetrical bias) of AC voltage having peak-to-peak voltage Vpp=1.3 kV, frequency f=2.7 kHz and positive duty 35% was applied.

With the clearance between the photosensitive drum and the sleeve set to 230 μm, reversal development was performed using positive toner having a volume average diameter of 7 μm of the above-described toner.

As a result, the toner on the development sleeve could have as sufficient amount of toner conveyance as 0.8 mg/cm$^2$ and as sufficient amount of charge as 11 μC/g, and even if 100,000 sheets of A4-size were printed (printing ratio 6% converted into original), the degradation in density decreased by about 0.1 (about 1.4 at the beginning). Degradation in image and the like were hardly seen.

As a comparative example, when a development sleeve made of stainless steel (SUS316) was caused to be subjected to sandblasting treatment using glass beads #300 on the surface, and reversal development was performed using positively-chargeable magnetic toner (average particle diameter 7 μm) for continuously forming images, the following phenomena occurred. In this respect, the blasting pressure for the SUS sleeve was set to a slightly higher value than in the case of the aluminum sleeve in order to have the same roughness as the aluminum sleeve.

(1) When the number of sheets printed reached 2,000 to 5,000 sheets, the image density decreased from 1.3 to 1.0.

(2) When the toner on the development sleeve at a point of time whereat the image density decreases is removed, the development sleeve is washed with solvent and thereafter is used again for development, the development sleeve recovers the image density.

Thus, when the toner amount of frictional charge at a point of time whereat the image density decreases was measured, it was ½ (one half) or less of the toner amount of charge at the commencement of image formation, and it has been found that the decrease in the toner amount of charge causes the image density to decrease.

On the other hand, in the case of the aluminum sleeve subjected to the above-described electroless Ni-P plating, the toner amount of charge only decreased somewhat. The foregoing is summarized as shown in Table 3.

TABLE 3

| | Sleeve material, surface treatment | Number of sheets continuously printed | Density decrease | Change in charge amount of toner |
|---|---|---|---|---|
| First experimental example | Al alloy + Blasting + Ni—P plating | 100,000 sheets | about 0.1 | about 11 μC/g → about 9 μC/g |
| Comparative example | SUS + blasting | 5,000 sheets | about 0.3 | about 12 μC/g → about 6 μC/g |

From the foregoing, it is found that the present invention is effective to prevent the sleeve contamination.

Second Experimental Example

In this experiment, by combining a developer unit with the same development sleeve as in the first experimental example incorporated therein with an analog copying apparatus of a negative electrification system in which an OPC drum, we studied a case where a development sleeve according to the present invention is applied to image formation in the negative electrification system.

A photosensitive drum 1 consists of an OPC drum as described above, and the gap between the photosensitive drum and the development sleeve was set to 250 μm. The photosensitive drum was charged at the surface potential −700 V, a latent image was formed at surface potential (non-image portion) −150 V, and normal development was performed using positively-chargeable magnetic toner having an average particle diameter of 7 μm previously described. To the development sleeve, development bias in which DC voltage of −550 V is superimposed on a square wave (symmetrical bias) of AC voltage having peak-to-peak voltage Vpp=1.5 kV, frequency f=2.2 kHz and duty 50% was applied.

As a result, the toner on the development sleeve could have as appropriate an amount of toner conveyance as 0.88 mg/cm$^2$ and as amount of charge as 11 μC/g. Even if 100,000 sheets of A4-size were printed, no density decrease nor deterioration and the like in the image were seen.

From the foregoing, it can be seen that the development sleeve according to the present invention is effective even if it may be applied to a developer unit for use in a negative electrification system of image forming apparatus.

Second Embodiment

This embodiment is, in a digital copying apparatus shown in FIG. 9 which has been described in the First Embodiment, the same as in the First Embodiment in the image formation conditions and the like except for the use of a development sleeve subjected to electroless Cr plating.

The development sleeve 6 is prepared by roughening the surface of an aluminum sleeve by the blasting treatment using spherical glass beads, and performing electroless Cr plating to cause it to have surface roughness Ra of 0.5 μm, plating thickness of 5 μm, and hardness Hv of about 600. The other structure of the developer device 3 is the same as the developer device 3 described in FIG. 1.

At this time, the amount of toner conveyance on the development sleeve was 0.8 mg/cm$^2$ and the amount of toner charge was 13 $\mu$C/g. In this case, while this embodiment is nearly the same in the amount of toner conveyance as in the First Embodiment, it is larger in the amount of toner charge than the First Embodiment. This is seemingly because Cr in this Second Embodiment has higher electrification property to toner than the material of Ni-P in the First Embodiment.

Although higher electrification property of toner is generally advantageous for image density, if it is too high, particularly when used at low humidities, the amount of charge is further increased, and therefore, it is known that local excessive electrification on the sleeve causes defective coat or the like. The difference to such a degree as described above, however, does not cause such a harmful influence nor any noticeable rise in image density.

In any case, even in this Second Embodiment, it has been confirmed that the initial image is at a satisfactory level, and that the density decrease at a point of time whereat the continuous copying test for 100,000 sheets was performed is as little as about 0.1.

Further, when the continuous copying test was continued and the sleeve shaved (here, a portion which has become thinner as compared with the initial diameter is assumed to be "the sleeve shaved") at a point of time whereat 1,000,000 sheets were printed was measured, it was confirmed that it is as very small as a little less than 1 $\mu$m even in average.

This is seemingly because the electroless Cr plating has further higher hardness than the electroless Ni-P plating of the First Embodiment. Normally, the Ni-P plating has Hv=about 450 so long as no annealing is performed, whereas the electroless Cr plating has as high hardness as Hv=600. For your reference, the amount of shaving in the Ni-P plating of the First Embodiment is about 1.5 $\mu$m in average, and the electroless Cr plating is predicted to have as small an amount of shaving as about half, and it is possible to extend the life of the sleeve.

Third Embodiment

Figure 10:
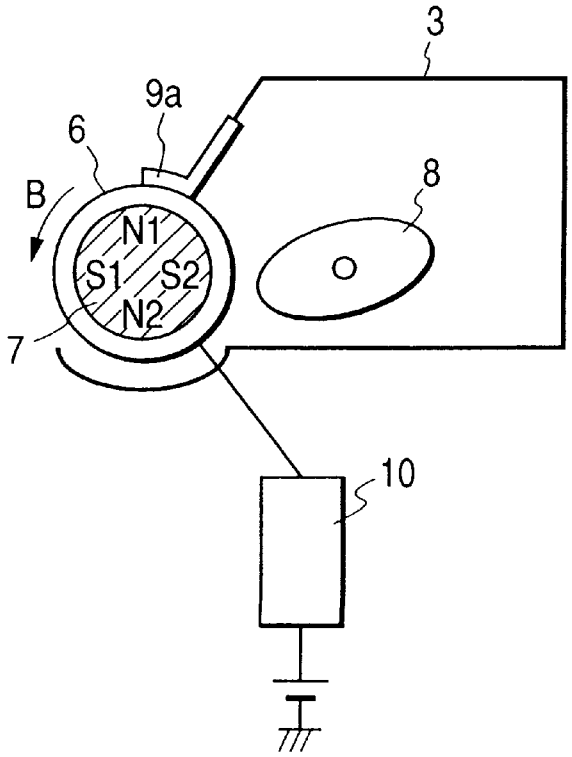
FIG. 10 is a schematic structural view showing a developer unit according to still another embodiment of the present invention.

In this embodiment, as shown in FIG. 10, an elastic blade 9*a* was used instead of the magnetic blade as a developer regulating member in a developer device 3, and this elastic blade was caused to abut upon a development sleeve 6 directly. Also, for the development sleeve 6, a sleeve subjected to the electroless Cr plating described in the Second Embodiment was used.

The mechanical structure of an image forming apparatus itself according to this embodiment is basically the same as the First Embodiment of FIG. 1.

For a photosensitive drum 1, an OPC drum was employed, and the gap between the photosensitive drum and the development sleeve was set to 300 $\mu$m. The surface of the photosensitive drum was charged at −600 V, a latent image was formed at surface potential −100 V by image exposure, and normal development was performed using negatively-chargeable magnetic toner. To the development sleeve, development bias in which DC voltage (−450 V) is superimposed on a square wave of AC voltage (Vpp=1.5 kV, f=2.2 kHz and duty 50%) was applied for image formation.

The elastic blade is caused to abut at as low a pressure as an abutting pressure of about 12 g/cm, in antinode contact instead of edge contact. The abutting nip at this time was about 1 mm.

Both the amount of toner conveyance (about 0.6 mg/cm$^2$) and the amount of charge (about 18 $\mu$C/g) were good, and the initial image was further improved in image quality because of higher amount of charge than in the First Embodiment, and yet no blotch was caused even at high amount of charge because of the contact elastic blade. Confirming that there is no problem, the continuous copying test was performed. In such elastic blade coat as this embodiment, the sleeve contamination tends to occur earlier because the elastic blade rubs the toner on the sleeve while abutting, but in this embodiment, it has been confirmed that there is no problem concerning density decrease and deterioration of the image in the continuous copying test for 10,000 sheets.

As regards the sleeve shaved, the sleeve is easily shaved because the elastic blade abuts, but the amount of shaving was small because the sleeve is hard because of electroless Cr plating. It was about 2.5 $\mu$m at a point of time whereat 10,000 sheets were printed. For this reason, if necessary, it is also possible to provide a toner peeling/coating roller for preventing sleeve ghost upstream of the elastic blade so as to cause it to abut upon the sleeve. Of course, shaving of the sleeve is considered to be further increased, but since the plating thickness is set to 5 $\mu$m, for example, a cartridge type of developer unit or the like will be able to maintain its performance without its plating shaved and lost until about 10,000 sheets which is the endurance life of the use.

In this embodiment, an elastic blade 9*a* was employed as a developer regulating member, but a roller made of a single-foam elastic member may be employed, and this roller is employed so as to cause it to abut upon the development sleeve. Even when a regulating roller made of such single-foam elastic member is employed, the present invention is effective.

Fourth Embodiment

In this embodiment, the same electroless Ni-P plating as the sleeve described in the First Embodiment was performed to form an image employing the developer unit and the image forming apparatus which have been described in the First Embodiment. In this embodiment, however, the development sleeve was different from the development sleeve described in the First Embodiment in plating layer thickness, and the sleeve of this embodiment had plating thickness double or more the volume average diameter of the toner for use.

As described above, it is effective for preventing the sleeve contamination to fill in microscopic cracks by plating, but it is wasteful in respect of cost to make the thickness thicker than necessary. It is possible to restrain the cost to a minimum while improving the performance by forming a necessary and sufficient plating thickness.

With reference to FIGS. 11A to 12C, the plating thickness will be described.

Figure 11A:
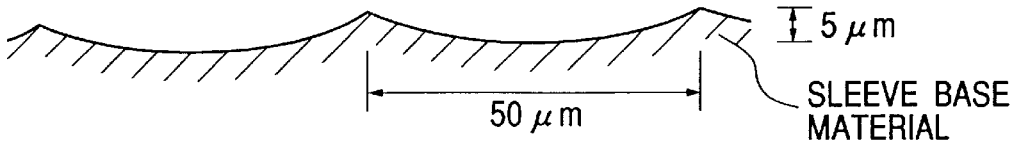
FIG. 11A is a cross-sectional view showing an ideal surface state of the sleeve after subjected to blasting using spherical particles.

FIG. 11A shows an ideal state of asperities produced when soft metal was blasted with spherical particles. The height of crater-shaped wave surface (correspond to roughness Rz or the like) is about 5 $\mu$m, and it is continuous with the interval (corresponds to average thread interval Sm) of about 50 $\mu$m.

FIG. 11A is a schematic view showing a state of asperities after actual blasting, but there actually exist microscopic cracks within the concave portions. These are mainly those 5 $\mu$m or less and about 5 $\mu$m in depth as described above. Accordingly, in FIG. 11B, Rmax and the like have naturally higher numerical values than in FIG. 11A, but Rz, Ra, Sm and the like are not much different.

Figures 12A, 12B, 12C:
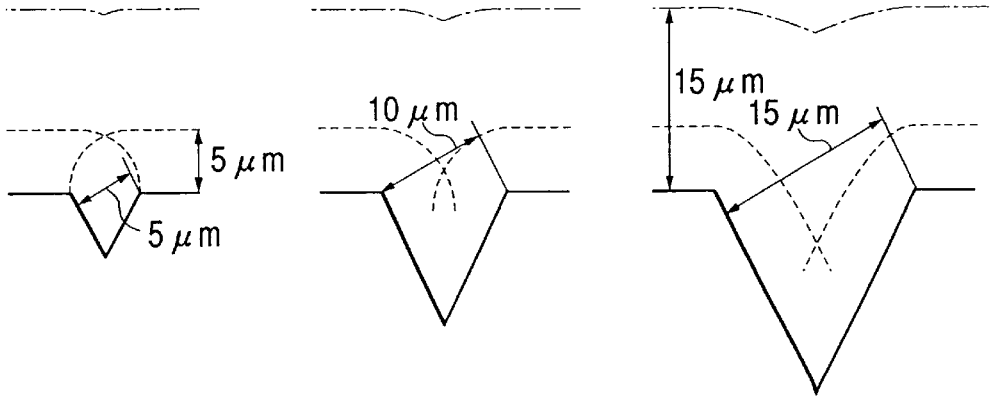
FIGS. 12A, 12B and 12C are schematic views showing minute cracks having a depth of 5, 10 and 15 $\mu$m respectively and how to cover the cracks after plating.

One of microscopic cracks is taken out and is schematically shown in FIGS. 12A to 12C, and it is described as a crack on a flat plane.

This crack having a size of 5 $\mu$m is shown in FIG. 12A, the crack having a size of 10 $\mu$m is shown in FIG. 12B, and the crack having a size of 15 $\mu$m is shown in FIG. 12C.

As can be seen from the optical photograph for the sleeve surface on which the aluminum has been blasted with spherical particles as shown in FIG. 3, cracks about 5 μm or less have the greatest number, cracks of 10 μm exceptionally exist, and cracks of 15 μm hardly exist. This is also indicated by the numerals of roughness. Although the 10 μm and 15 μm class cracks are naturally also deep in depth, they would affect the numerals for Rz and the like if they were present in large quantities.

In order to describe relationship between plating thickness and toner particle diameter, first the description will be made of average particle diameter of toner and the particle size distribution.

Figure 13:
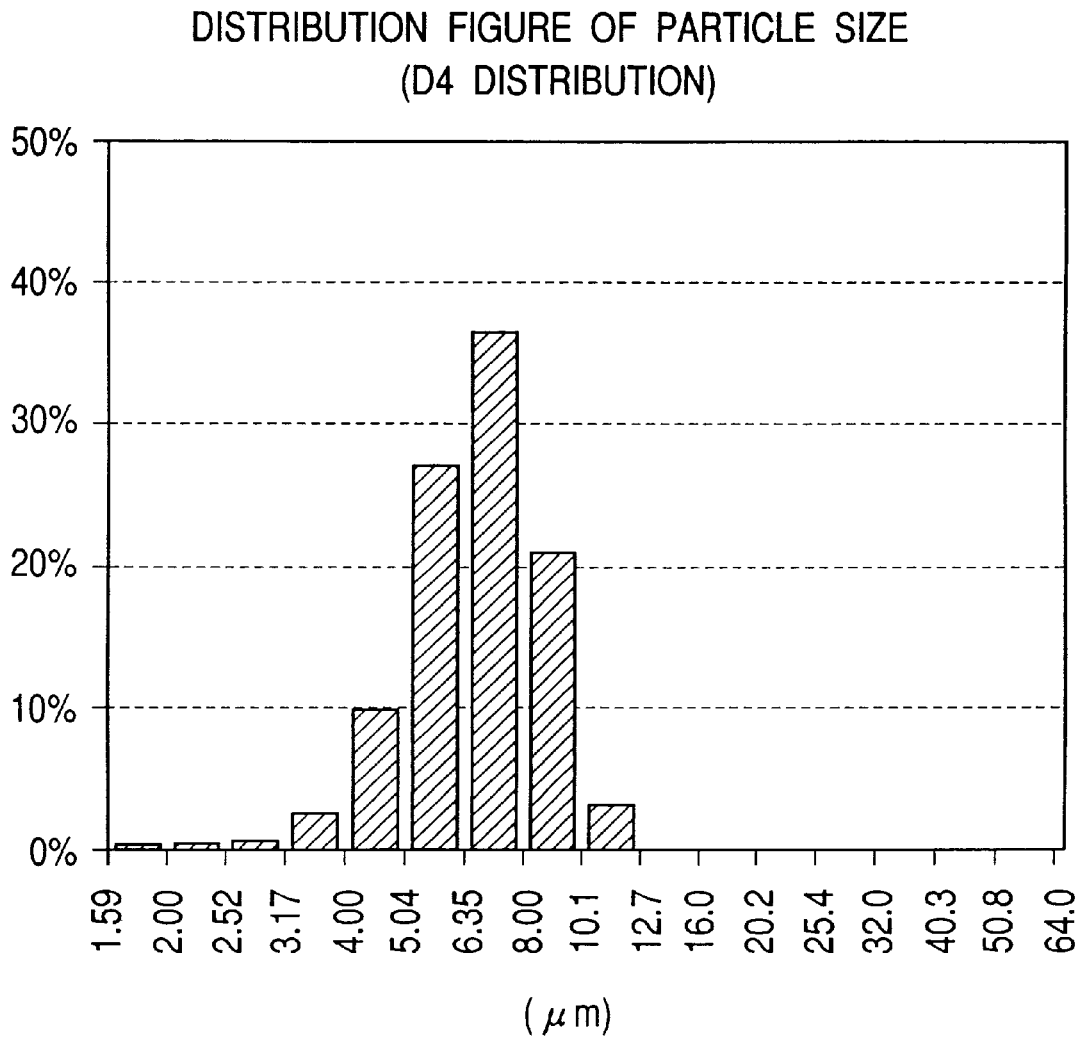
FIG. 13 is a distribution figure of particle size for toner having volume average particle size of 7 $\mu$m.

The toner for use has a volume average diameter of 7 μm, and its particle size distribution is shown in FIG. 13. Fine powder 4 μm or less accounts for 15 to 20% in number, those in the vicinity of the central particle diameter of 6 to 8 μm account for 70% in number, and both account for 80 to 90% of the whole in number.

As shown in FIG. 12A, when plating with thickness of 5 μm is performed on a crack of about 5 μm, the plating comes to have such a surface as shown by the broken line in FIG. 12A, and the crack is almost all filled in. By filling in the greatest number of cracks by plating, it is possible to prevent these cracks from being imbedded with fine powder (about 4 μm or less), and it is considered to be effective for preventing the sleeve contamination.

On the other hand, as regards about 10 μm cracks, the surface of plating formed at a plating thickness of 5 μm is as shown by broken line in FIG. 12B, and the cracks actually remain at nearly the same size as 4 to 5 μm class cracks. Fine toner powder is prone to be imbedded in there.

Also, naturally, it is considered that such large cracks as shown in FIG. 12C are actually hardly present, but as regards about 15 μm cracks, the entire crack cannot be filled in by plating about 5 μm like its surface shape indicated by broken line in the figure. At this time, approximately 8 to 10 μm crack remains. In this crack, toner of about average particle diameter will be imbedded.

For this reason, it can be seen that plating thickness of 5 μm is insufficient for large cracks from the beginning.

On the basis of this, "To form plating thickness twice or more the toner average particle diameter" in this embodiment will be described.

The alternate long and short dash lines in FIGS. 12B and 12C indicate the surface shape when the plating layer is formed at a thickness of 15 μm. Since the central particle diameter of the toner is 7 μm, 15 μm plating was performed. It can be both seen that the cracks are sufficiently filled in by the plating layer. Therefore, both fine powder and toner of central particle diameter are never embedded in these cracks, and it is considered to be sufficiently effective to prevent the sleeve contamination.

As described above, with the provision of a plating layer twice or more the toner particle diameter, it is possible to have more resistant sleeve to the sleeve contamination, and the relationship with the toner particle diameter will be described below.

In the first place, if there are larger cracks on the surface after blasting, there will still remain some cracks even if thick plating is performed. In view of toner conveying ability, the sleeve roughness is usually set to nearly equal to or less than the toner particle diameter. Of course, it may be possible to make it rougher from a design viewpoint, but it is not necessary to do so from a quality viewpoint. Generally, when toner having a particle diameter about 6 to 12 μm is used, the sleeve roughness is mostly set to Rz of about 3 to 10 μm. Therefore, such a large crack as shown in FIG. 12C is considered to be the largest one assumed. However, they are considered to be few.

First, if plating with the nearly same plating thickness as the toner particle diameter is performed for an ordinary development sleeve, such a microscopic crack as shown in FIG. 12A can be filled in, but such a comparatively large crack as shown in FIG. 12B cannot be filled in completely, but fine powder may enter there. Furthermore, although there are few in number, toner of the central particle diameter or so is likely to enter such a large crack as shown in FIG. 12C.

On the other hand, if plating with thickness twice or more the central particle diameter of toner for use is performed, such a comparatively large crack as shown in FIG. 12B can be filled in completely, and further, even such a large crack as shown in FIG. 12C can be sufficiently filled in. Therefore, fine toner powder can be caused not to enter. Furthermore, all cracks in which there is space for toner with the central particle diameter or less accounting for about 90% in number of toner to enter can be filled in completely, and the sleeve contamination can be securely prevented. Therefore, this plating thickness is considered to be a necessary and enough thickness. Of course, even at this time, since it is finished as a sleeve having surface roughness nearly equal to or less than the toner particle diameter, it is also sufficient in view of toner conveying ability.

To thus make the plating thicker is effective to prevent the sleeve contamination, and this should be designed on the basis of the duration of life required for the sleeve in the developer unit and toner material (susceptible to contamination, and the like). High-hardness plating may not necessarily be applied to a sleeve such as LBP having a short duration of life.

If the plating thickness is thus optimized, even a SUS sleeve can be used although the sleeve prepared by blasting an aluminum sleeve using spherical particles has been used so far. In other words, there is no need for the use of aluminum or the like which is comparatively soft metal as sleeve base material. Since, however, the SUS is more expensive than aluminum, the aluminum is, of course, preferable in terms of both cost and prevention of the sleeve contamination.

Figure 11B:
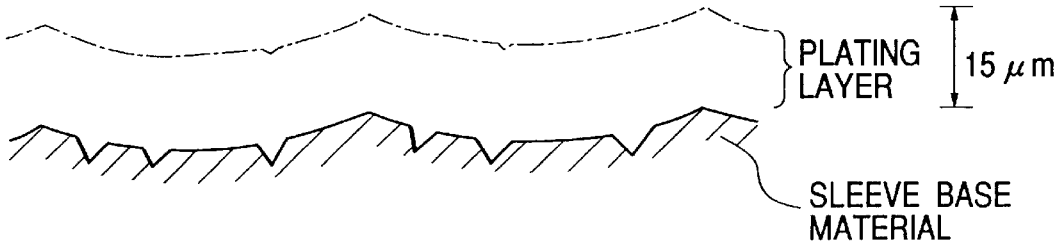
FIG. 11B is a cross-sectional view showing an actual surface state of the sleeve after subjected to blasting using spherical particles, and the surface state of the sleeve when a plating layer is provided on the surface.

In this respect, when thick plating is performed, the sleeve surface in FIG. 11B is indicated by an alternate long and short dash line, and those microscopic cracks are filled in by thick plating, but large asperities almost all remain. Therefore, roughness parameters Rz, Ra, Sm and the like do not much change although, of course, the roughness tends to decrease.

Using this sleeve, continuous copying was performed under the same conditions as the first experimental example of the First Embodiment, and as a result, the sleeve life was further extended, and there was no problems even in the 500,000 sheets endurance test.

While the invention has been described in terms of its embodiments, the present invention is not restrained to these embodiments, but various changes and modifications can be made in it without departing the spirit and scope thereof.

What is claimed is:

1. A method of manufacturing a developer bearing body for bearing a developer, comprising the steps of:

preparing a metallic base material;

blasting a surface of said metallic base material using spherical particles; and plating said blasted surface of said metallic base material, wherein a thickness of said plating layer is two or more times as large as a particle diameter in volume average of the developer.

2. A method of manufacturing a developer bearing body according to claim 1, wherein said metallic base material is an aluminum alloy.

3. A method of manufacturing a developer bearing body according to claim 1, wherein said metallic base material is a copper alloy.

4. A method of manufacturing a developer bearing body according to claim 1, wherein said plating is an electroless plating.

5. A method of manufacturing a developer bearing body according to claim 1, wherein said plating is one of Ni-P plating, Ni-B plating, Pd-P plating, and Cr plating.

6. A developer bearing body for bearing a developer, comprising:

a metallic base material whose surface has been blasted using spherical particles; and a plating layer provided on said blasted surface of metallic base material, wherein a thickness of said plating layer is two or more times as large as a particle diameter in volume average of the developer.

7. A developer bearing body according to claim 6, wherein said metallic base material comprises a nonmagnetic metal and is sleeve-shaped.

8. A developer bearing body according to claim 7, wherein said nonmagnetic metal is an aluminum alloy.

9. A developer bearing body according to claim 7 wherein said nonmagnetic metal is a copper alloy.

10. A developer bearing body according to claim 6, wherein said metallic base material has a Vickers hardness Hv of 50 to 200.

11. A developer bearing body according to claim 6, wherein said plating layer is an electroless plating layer.

12. A developer bearing body according to claim 11, wherein said electroless plating layer has a thickness of 5 to 25 $\mu$m.

13. A developer bearing body according to claim 11, wherein said electroless plating layer has a Vickers hardness Hv of 200 or more.

14. A developer bearing body according to claim 13, wherein said electroless plating layer has a Vickers hardness in the range of Hv of 450 to 1,000 inclusive.

15. A developer bearing body according to claim 11, wherein a surface of said electroless plating layer substantially retains a concave shape on said metallic base material caused by a collision of said surface of said electroless plating layer by spherical particles.

16. A developer bearing body according to claim 15, wherein an interior of concave portions on said surface of said electroless plating layer is a substantially mirror surface.

17. A developer bearing body according to claim 11, wherein said surface of said electroless plating layer has a roughness Rz of 2 to 15 $\mu$m.

18. A developer bearing body according to claim 11, wherein said surface of said electroless plating layer has a roughness Ra of 0.3 to 1.5 $\mu$m.

19. A developer bearing body according to claim 11, wherein said plating is one of Ni-P plating, Ni-B plating, Pd-P plating, and Cr plating.

20. A developing apparatus, comprising:

a developing container for containing developer; and a developer bearing body provided at an opening of said developing container, for bearing and conveying the developer, said developer bearing body including a metallic base material, which is blasted by spherical particles, and a plating layer provided on the blasted metallic base material, wherein a thickness of said plating layer is two or more times as large as a particle diameter in volume average of the developer.

21. A developing apparatus according to claim 20, wherein the developer is a positively-chargeable, monocomponent toner.

22. A developing apparatus according to claim 20, wherein said developer bearing body is disposed so as to be opposed to a heated image-bearing body.

23. A developing apparatus according to claim 22, wherein said image-bearing body comprises an amorphous, silicon photosensitive layer.

24. A developing apparatus according to claim 20, wherein the metallic base material is nonmagnetic and is sleeve-shaped, and said apparatus further comprises a magnetic field generating member within said sleeve-shaped metallic base material.

25. A developing apparatus according to claim 24, wherein the developer is magnetic, monocomponent toner.

26. A developing apparatus according to claim 24, wherein the nonmagnetic metal is an aluminum alloy.

27. A developing apparatus according to claim 24, wherein the nonmagnetic metal is a copper alloy.

28. A developing apparatus according to claim 20, wherein the developer is monocomponent toner having a particle diameter in volume average of 8 $\mu$m or less.

29. A developing apparatus according to claim 20, wherein said metallic base material has a Vickers hardness Hv of 50 to 200.

30. A developing apparatus according to claim 20, wherein said plating layer is an electroless plating layer.

31. A developing apparatus according to claim 30, wherein said electroless plating layer has a thickness of 5 to 25 $\mu$m.

32. A developing apparatus according to claim 30, wherein said electroless plating layer has a Vickers hardness Hv of 200 or more.

33. A developing apparatus according to claim 30, wherein said electroless plating layer has a Vickers hardness Hv of 450 to 1,000 inclusive.

34. A developing apparatus according to claim 30, wherein a surface of said electroless plating layer substantially retains a concave shape on said metallic base material caused by collision by spherical particles.

35. A developing apparatus according to claim 34, wherein an interior of concave portions on said surface of said electroless plating layer is a substantially mirror surface.

36. A developing apparatus according to claim 30 wherein said surface of said electroless plating layer has a roughness Rz of 2 to 15 $\mu$m.

37. A developing apparatus according to claim 30, wherein said surface of said electroless plating layer has a roughness Ra of 0.3 to 1.5 $\mu$m.

38. A developing apparatus according to claim 30, wherein said plating is one of Ni-P plating, Ni-B plating, Pd-P plating and Cr plating.

* * * * *

UNITED STATES PATENT AND TRADEMARK OFFICE

CERTIFICATE OF CORRECTION

PATENT NO. : 6,178,306 B1
DATED : January 23, 2001
INVENTOR(S) : Yoshito Mizoguchi, et al.

It is certified that error appears in the above-identified patent and that said Letters Patent is hereby corrected as shown below:

Column 7,
Line 4, "non-magnetic" should read -- nonmagnetic --.

Column 11,
Line 54, "thinn" should read -- thin --;
Line 60, "Coletar" should read -- Coulter -- and "Cole-" should read -- Coulter --; and
Line 61, "tar" should be deleted and "Coletar" should read -- Coulter --.

Column 12,
Line 7, "Coletar" should read -- Coulter --.

Column 14,
Line 30, "for" should read -- or --; and
Line 43, "ditertiali" should read -- tertiary --.

Column 23,
Line 24, "claim 7" should read -- claim 7, --.

Column 24,
Line 33, "50" should read -- 560 --; and
Line 53, "claim 30" should read -- claim 30, --.

Signed and Sealed this

Fourth day of December, 2001

*Attest:*

Nicholas P. Godici

NICHOLAS P. GODICI
*Acting Director of the United States Patent and Trademark Office*

*Attesting Officer*